US006427511B1

(12) United States Patent
Kutschker et al.

(10) Patent No.: US 6,427,511 B1
(45) Date of Patent: Aug. 6, 2002

(54) BENDING MACHINE

(75) Inventors: Wolfgang Kutschker, Boeblingen; Erwin Pesold, Sindelfingen, both of (DE)

(73) Assignee: Reinhardt Maschinenbau GmbH, Sindelfingen (DE)

( * ) Notice: Subject to any disclaimer, the term of this patent is extended or adjusted under 35 U.S.C. 154(b) by 0 days.

(21) Appl. No.: 09/665,152

(22) Filed: Sep. 19, 2000

Related U.S. Application Data

(63) Continuation of application No. PCT/EP00/00124, filed on Jan. 11, 2000.

(30) Foreign Application Priority Data

Jan. 19, 1999 (DE) ..... 199 01 797

(51) Int. Cl.[7] ..... B21D 5/04
(52) U.S. Cl. ..... 72/319
(58) Field of Search ..... 72/319–321, 316

(56) References Cited

U.S. PATENT DOCUMENTS 4,510,785 A * 4/1985 Triouleyre ..... 72/319
5,694,801 A * 12/1997 Takahashi ..... 72/319

FOREIGN PATENT DOCUMENTS

| | | | |
|---|---|---|---|
| DE | 26 14 177 | * 10/1976 | ..... 72/319 |
| DE | 28 25 591 | 5/1979 | |
| DE | 42 06 417 | 9/1993 | |
| EP | 0 039 322 | 11/1981 | |
| WO | WO 92/00154 | 1/1992 | |

* cited by examiner

*Primary Examiner*—Daniel C. Crane
(74) *Attorney, Agent, or Firm*—Barry R. Lipsitz; Douglas M. McAllister

(57) ABSTRACT

A bending machine for flat material, comprising a lower beam and an upper beam, with which the flat material can be fixed, a lower as well as an upper bending tool moving device, with which the bending tool not used for an operation on the flat material can be brought into a rest position, in which a bending space free from machine elements of the bending machine exists between the clamping plane and the bending tool located in the rest position and its bending tool carrier, this space extending over an angular area of at least 100° around the respectively operative bending edge.

64 Claims, 10 Drawing Sheets

60
78
12
62
74
350
320
312
64
322
310
424
66
106
76
82
72
52
54
48
44
134
70
126
124
46
102
104
26
122
132
138
136
128
130
140
24
112
40
42
38
190
30
210
32
22
28
20
34
84
86
18b
88
90
36
92
18a 64
66
234
232
46
116
142
168
206
200
170
182
202
190
192
194
204
158
166
150
156
212
188
152
210
184
154
208
186
214
216
164
218
162
160
22

BENDING MACHINE

This application is a continuation of PCT/EP00/00124, filed Jan. 11, 2000, the entire specification of which is incorporated herein by reference.

The invention relates to a bending machine for flat material, comprising a machine frame, a lower beam arranged on the machine frame and having a lower clamping tool and an upper beam arranged on the machine frame and having an upper clamping tool, with which the flat material can be fixed in a clamping plane, a lower bending tool moving device which is associated with the lower beam and with which a lower bending tool carrier with a lower bending tool for bending the flat material about an upper bending edge relative to the clamping plane can be moved between a rest position and a plurality of bending positions, an upper bending tool moving device which is associated with the upper beam and with which an upper bending tool carrier with an upper bending tool for bending the flat material about a lower bending edge relative to the clamping plane can be moved between a rest position and a plurality of bending positions.

A machine of this type is known from the state of the art, for example, DE 42 06 417. With this machine, there is the problem, on the one hand, of the pivoting of a bending beam bearing the bending tool being constructionally complicated and, on the other hand, of the type of possible bending operations being limited on account of the space.

The object underlying the invention is therefore to improve a bending machine of the generic type such that the type of possible bending operations is subject as little as possible to restrictions.

This object is accomplished in accordance with the invention, in a bending machine of the type described at the outset, in that the bending tool not used for an operation on the flat material can be brought into a rest position, in which a bending space free from machine elements of the bending machine exists between the clamping plane and the bending tool located in the rest position and its bending tool carrier, this space extending over an angular area of at least 110° around the respectively operative bending edge.

The advantage of the inventive solution is to be seen in the fact that with it a bending space is available which did not exist in the known machines, namely neither in the direction of the clamping plane away from the clamping tools nor about the respectively operative bending edge.

It is possible, in particular, with the inventive solution to operate with flat material projecting far beyond the clamping tools within the bending space comprising the clamping plane and the angular area in a direction pointing away from the clamping tools and the machine frame, wherein the extension of the flat material in this direction is limited merely by the surroundings of the bending machine, i.e., for example, other machines or the machine hall.

However, the inventive solution also creates, on the other hand, the possibility, as a result of the bending space free from machine elements of the bending machine, of being able to use additional devices, such as, for example, handling devices which then have the possibility of interacting with the flat material, for example, of grasping the flat material in the bending space unhindered by the machine elements of the bending machine in order to be able to carry out additional functions, for example, any handling without any risk of collision with the operating bending tool existing.

The inventive bending machine has, in particular, for each of the bending tools no machine element in an angular area of at least 100° which interferes with any bending operation and so with each of the two bending tools bending operations can be carried out which far exceed a right angle and thus complex bent parts with several bendings in different directions can be produced in one operating run.

The bending space is preferably dimensioned such that it extends around the operative bending edge over an angular area of at least 120°. It is even more advantageous when the bending space extends around the bending edge over an angular area of at least 130°.

Such a bending space may be realized particularly favorably when the bending tool carrier is located close to a front surface of the respective beam in the rest position, i.e., is removed as far as possible from the front plane and is arranged in the direction of the respective beam.

One embodiment of an inventive bending machine having optimum bending possibilities provides for the bending tool moving device of the bending tool in rest position to be located outside the bending space defined by the angular area.

With respect to the arrangement of the bending tool moving device, no further details have so far been given. In principle, it would be conceivable to design the inventive bending machine such that the bending tool moving device is arranged in the area of side columns of the machine frame. However, in order to obtain a machine which is of as narrow a construction as possible and, in particular, a machine with an extension in longitudinal direction which is variable, it is preferably provided for the bending tool moving device for the respective bending tool to be arranged between lateral end surfaces of the beams. Such an arrangement of the bending tool moving device has, in addition, the advantage that this allows a more uniform supporting of the bending tool and so, as a result,—particularly in the case of long bending machines—problems are also avoided with respect to the bowing of the bending tool under load.

Furthermore, one advantageous embodiment of an inventive bending machine provides for the bending tool moving device for the respective bending tool, in all the bending positions of the bending tool, to be located exclusively on the side of the clamping plane, on which the starting bending position of the bending tool is located. The result of such an arrangement of the bending tool moving device is that the bending machine can be of a very compact construction and, in particular, a front space in front of the clamping tools, into which the metal sheet to be bent projects, is affected to as small a degree as possible by the bending tool moving device in order to obtain as great a degree of freedom as possible with respect to the possible bending operations and/or handling operations.

It is even more advantageous, in particular, when the bending tool moving device extends, in all the bending positions, between the machine frame and a front limiting plane extending through the bending tool and at right angles to the clamping plane. Such a design of the bending tool moving device has the great advantage that no element whatsoever of the bending tool moving device and also of the machine frame is present in front of the front limiting plane and so the flat material can, in this area, project in an unhindered manner, be taken over by other machines or handled in any other manner. In addition, such a construction of an inventive bending machine also allows the possibility of arranging several machines to follow one another in the form of a production line, i.e., the possibility exists that the flat material which projects beyond the front limiting plane on a side located opposite the machine frame can be taken over by another machine in a simple manner.

With this solution it is, in particular, remarkable that the bending tool itself is the element which projects the most beyond the machine frame on a side of the clamping tools located opposite the machine frame and all the remaining machine parts of the bending machine, in particular, the machine frame itself and the bending tool moving device are located on the side of the front limiting plane facing the machine frame.

The inventive bending machine is even more advantageous when the bending tool moving device extends, in all the possible bending positions, between the machine frame and a front plane extending through the bending edge and at right angles to the clamping plane. As the front plane is located even closer to the machine frame than the front limiting plane, an even greater free space is created in this case on the side of the front plane located opposite the machine frame and this space may be utilized, on the one hand, for a plurality of bending operations and, on the other hand, for handling the bent flat material, as well.

With respect to the design of the bending tool carrier itself, no further details have been given in conjunction with the preceding embodiments. It is particularly advantageous when the bending tool carrier is also located, in all the possible bending positions, between the respective beam and a limiting plane intersecting the bending tool and extending at right angles to the clamping plane since, as a result, it is ensured that even the bending tool carrier does not project beyond this limiting plane and thus the bending tool itself is the only element of the bending machine which extends the furthest away from the clamping tools on a side thereof facing away from the machine frame.

It is even more advantageous when the bending tool carrier extends, in all the possible bending positions, between the machine frame and a front plane extending through the bending edge and at right angles to the clamping plane, and is thus arranged even closer to the machine frame, so that only the bending tool projects beyond the front plane on the side located opposite the machine frame.

In this respect, the bending tools are preferably of an identical design and each driven with an identical bending tool moving device provided for each bending tool.

It is particularly advantageous when the bending tool not used for an operation on the flat material is always in the rest position so that it can be assumed that the bending tool never represents any hindrance for any bending with the other bending tool when it is not being used.

This solution comprises all the instances of application, with which, during use of one of the bending tools, the other bending tool is always in the rest position. This solution does not, however, preclude the fact that, where appropriate for special operations, for example, for folding operations or other special bending operations or handling operations, both bending tools are used and engage on the flat material at the same time or immediately and quickly one after the other.

With respect to the design of the bending tool moving device in detail, no further particulars have so far been given. In principle, the bending tool moving device can comprise all the conceivable forms of realization so far used with bending machines which fulfill the inventive requirements. A particularly advantageous development of the bending tool moving device provides for this to have a plurality of holding elements which engage in an area of the bending tool carrier facing the bending tool and are arranged at fixed distances from one another in a direction parallel to the longitudinal direction of the bending edge, these holding elements supporting the bending tool carrier in relation to the machine frame. Such a design of the support for the bending tool carrier relative to the machine frame has the advantage that, as a result, the stability of the bending tool carrier itself need not—as, for example, with bending machines with side columns and bending tool moving devices arranged in them—be configured such that this withstands the bending forces as a part extending freely between the side columns and, nevertheless, has a low degree of bowing under load. On the contrary, this solution of providing holding elements arranged at a distance from one another offers the possibility of supporting the bending tool carrier on the machine frame at a plurality of locations in its longitudinal direction and so the bending tool carrier need only be designed to be stable enough to have an adequate deformation stability over the distances between the individual holding elements.

The holding elements can, however, be used not only for the purpose of being able to reduce the stability of the bending tool carrier itself. On the contrary, the holding elements can also be advantageously used for serving as guide means for a defined movement of a point of engagement thereof on the bending tool carrier and thus also for contributing to the determination of the path, on which the bending tool moves while passing through the individual bending positions.

The holding elements are preferably designed such that they guide the point of engagement on a predetermined path which, superimposed with other movements, contributes to the path, on which the bending tool moves.

Such a guidance for the bending tool carrier may be designed mechanically in a particularly simple manner when the holding elements engage on the bending tool carrier in an articulated manner. In addition, it is of advantage when the holding elements are mounted so as to be articulated in relation to the machine frame.

It is particularly favorable when the holding elements represent connection bars which engage, on the one hand, on the machine frame in an articulated manner and, on the other hand, on the bending tool carrier in an articulated manner so that a path movement of the point of engagement of the connection bars on the bending tool carrier may be defined in a simple manner via these connection bars and, in addition, large forces can be transferred from the bending tool carrier to the machine frame in a simple manner via the connection bars in order to give the bending tool carrier the adequate form stability during bending.

Such a point of engagement may be selected particularly favorably when the holding elements engage on the beam, with which the respective bending tool is associated.

Apart from such an arrangement of a plurality of holding elements, further measures are required to move the bending tool carrier such that the bending tool, in the long run, describes the path required in accordance with the invention in a precise manner.

This may be realized particularly favorably, also with respect to the stability of the bending tool carrier itself, when the bending tool carrier moving device has a plurality of bending tool carrier drive units which are arranged so as to follow one another in a direction parallel to the longitudinal direction of the bending edge for moving the bending tool between the starting bending position and the end bending position.

Since, with the inventive bending machine, the bending tool can also be expediently positioned in a rest position, it would, for example, be conceivable to reach the rest position by moving the entire bending tool moving device between a starting bending position and the rest position. It is, however, particularly favorable when the bending tool can also be moved by the bending tool carrier drive units between the rest position and the starting bending position.

In order to move the bending tool carrier, it is preferably provided for the bending tool carrier drive units to engage on the bending tool carrier at a point of engagement and move this between the starting bending position and the end bending position on a path predetermined in a defined manner. As a result of superposition of this path predetermined in a defined manner with additional path movements, for example, the path movements predetermined by the holding elements, the movement of the bending tool required in accordance with the invention may be expediently achieved on the path predetermined in a defined manner.

In principle, it would be conceivable, for example, to design the bending tool carrier drive device such that it guides the point of engagement on the path in the form of a numerically controlled path movement. However, this is complicated, on the one hand, with respect to the control resources and, on the other hand, also with respect to the forces to be generated for the path movement.

For this reason, it is preferably provided for the path to be predetermined by a pivoting movement about a pivot axis fixed in relation to the machine frame.

In the simplest case, the bending tool carrier drive units are designed in this respect such that they can be driven by a drive to carry out the path movements.

In this respect, a single drive will also be sufficient for a plurality of bending tool carrier drive units. It is, however, particularly advantageous when each of the bending tool carrier drive units can be driven by its own drive.

With respect to the design of the bending tool carrier drive units themselves, no further details have been given. One particularly advantageous embodiment provides, for example, for each of the bending tool carrier drive units to comprise a drive arm which can be pivotally driven, is pivotable at a first end about an axis fixed in relation to the machine frame and is pivotally connected to the bending tool carrier at a second end via an elbow joint. Such a design of the bending tool carrier drive units has the advantage that a definable movement of the bending tool carrier for determining the path of the bending tool can be realized as a result in a simple manner.

A particularly advantageous kinematic arrangement provides for each of the bending tool carrier drive units to have an elbow lever drive system for moving the bending tool carrier since complex movements can be generated with such an elbow lever drive system in a simple manner by adjusting the length of the elbow levers.

In order to be able to favorably define the path of the bending tool relative to the machine frame, it is preferably provided for a first lever of the elbow lever drive system to be pivotable about an axis fixed in relation to the machine frame.

In this respect, the elbow lever drive system could, in principle, be optionally actuated in that the drive engages on one of the levers of the elbow lever drive system. It is particularly favorable when the pivotally drivable drive arm forms the first lever of the elbow lever drive system.

With respect to the design of the second lever, it would be conceivable to provide for this purpose a special second lever which, for its part, again acts on the bending tool carrier. A solution, with which the bending tool carrier forms at least part of a second lever of the elbow lever drive system, is, however, mechanically favorable.

In order not to be tied exclusively to pivoting movements with respect to the determination of the movement of the bending tool carrier, a particularly favorable solution of the inventive bending tool carrier drive unit provides for the drive arm to be designed so as to be variable in length with respect to its distance between the first end and the second end. As a result, an additional translatory movement can be generated in addition to the pivoting movements.

This translatory movement may be used to provide the path provided for the bending tool, in addition, with path corrections from the starting bending position to the end bending position.

A solution is, however, particularly favorable, with which the length variability of the drive arm is used to move the bending tool back and forth between the starting bending position and the rest position.

For this purpose, it is expedient for the drive arm to be adjustable via a drive so as to be variable in length. Such a drive can, in principle, be a separate drive, with which the length of the drive arm can be adjusted at any time. This would be of advantage, in particular, when path corrections are also intended to be carried out by way of the length adjustment during the movement of the path of the bending tool between the starting bending position and the end bending position.

It is, however, particularly simple from a constructional point of view when the drive for pivoting the drive arm also serves as a drive for the length adjustment of the drive arm so that the length adjustment—for example, for moving the bending tool between the rest position and the starting bending position—and the movement of the bending tool on the desired path can be realized by means of one drive.

The length adjustment of the drive arm could, in principle, be brought about, for example, by a spindle adjusting means or any other adjusting mechanism. A particularly favorable solution does, however, provide for the drive arm to be variable in length on account of an elbow lever mechanism.

One form of realizing such an elbow lever mechanism provides for the drive arm to comprise an arm section extending from the first end as far as a center joint and an arm section extending from the center joint as far as the second end.

With such an elbow lever mechanism, the length adjustment of the drive arm can be realized in a particularly simple manner when the elbow lever mechanism can be secured in different extended positions to determine different lengths of the drive arm.

Such a determination of different extended positions may, in the simplest case, be brought about by blocking the movement of the arm sections relative to one another or also by locking the center joint in different positions.

In order to be able to determine these extended positions in a controlled manner, it is preferably provided for the elbow lever mechanism, for their determination, to be blocked by a blocking device which preferably acts either on the arm sections themselves or on the center joint.

With respect to generating the pivoting movements of the drive arm, no further details have so far been given. It would, for example, be conceivable to arrange the drive arm on a shaft and to initiate the pivoting movement thereof via this shaft. A particularly favorable solution does, however, provide for a pivot drive to engage on the first arm section of the elbow lever mechanism for pivoting the drive arm.

The pivot drive is preferably designed such that it engages on the center joint.

A solution which is particularly favorable from a mechanical point of view and with which the bending tool carrier co-acts as second lever of the elbow lever drive system provides for the bending tool carrier to be provided with arm extensions which extend in the direction of the drive arm and each of which forms with the bending tool carrier the second lever of the elbow lever drive system. In this respect, it is particularly favorable when the arm extensions are rigidly connected to the bending tool carrier and thus form one unit with it each time.

With respect to the arrangement of the bending tool moving device, no further details have so far been given. One advantageous embodiment, for example, provides for the bending tool moving device to engage at least partially on the beam, with which the bending tool is associated. Such an engagement on the beam, with which the bending tool is associated, has the advantage that, as a result, it is possible to support the guide means of the bending tool in part at least as close as possible to the clamping tools. If this takes place via a holding element as already described, it is preferably provided for each of the holding elements to engage on the respective beam.

An additional, advantageous support for the bending tool moving device is preferably brought about in that the bending tool carrier drive unit is arranged on the beam carrier of the respective beam and thus is likewise positioned on the machine frame in a suitable and space-saving manner.

Since, as a result of the use of an elbow lever mechanism, the movement of the elbow joint relative to the first arm section and also relative to the machine frame cannot be determined, it is preferably provided for the elbow joint to be movable along a defined path during the length alteration of the drive arm.

As a result, the possibility is created of guiding the elbow joint in a definitive manner and thus of also predetermining the movement of the bending tool exactly.

In the simplest case, it is provided for the path to extend in a straight line.

The realization of the guidance of the elbow joint along a path may be achieved in a particularly simple manner in that a path follower which extends along a connecting link predetermining the path is arranged on the elbow joint, wherein the connecting link is preferably arranged on the machine frame.

In order to be able to advantageously determine different positions of the bending tool by means of the path, it is provided for the connecting link to be adjustable into different positions relative to the machine frame.

The guidance of the elbow joint along the path may be used particularly advantageously for determining the movement between the rest position and the starting bending position of the bending tool. For this reason, it is preferably provided for the path follower to be movable along the connecting link during the movement of the bending tool from the rest position into the starting bending position.

After reaching the starting bending position, a further guidance of the elbow joint by means of the connecting link is no longer necessary in one particularly advantageous case since the starting bending position is preferably reached when the elbow lever mechanism is in its extended position determinable by the blocking device. For this reason, it is preferably provided for the path follower to lift away from the connecting link in the bending positions following the starting bending position.

In order to be able to process, in particular, elongated flat material with an inventive bending machine, it is preferably provided for the machine frame to be designed to be laterally open at at least one of its transverse sides for the insertion of flat material in longitudinal direction of the bending edge and between the upper beam and the lower beam. Such a design of the machine frame is advantageous, in particular, for flat material withdrawn from a coil or for long flat material parts which are to be fed laterally in a production line.

For such a laterally open design of the machine frame, it is fundamentally sufficient when an opening is present which extends in the direction of the clamping plane and is limited transversely to the bending edge and which is larger than an extension of the flat material to be supplied in this direction. It is, however, particularly favorable when the machine frame is designed to be open in the area of the clamping tools for the insertion of flat material between the clamping tools, as well, so that also flat material which has a greater extension transversely to the bending edge than, for example, the distance between a guide means of upper beam and lower beam relative to one another and the bending edge can already be inserted laterally between the clamping tools.

Such a design of the machine frame would also be conceivable when the machine frame has side columns; in this case, it would merely be necessary for the side columns to be provided with corresponding openings.

It is, however, particularly favorable when the machine frame is designed to be free from any side columns.

A particularly advantageous design of the machine frame provides for this to extend essentially only between lateral end surfaces of the upper beam and the lower beam.

One advantageous type of design for the machine frame provides for the machine frame to have at least two frame units which are arranged to extend one after the other in a direction parallel to the longitudinal direction of the bending edge and which hold the lower beam and the upper beam so as to be movable relative to one another. Such a solution is of advantage, in particular, with a view to the efficient production of bending machines with lengths of the upper beams and the lower beams varying in size since the number of frame units can vary from bending machine to bending machine with the length of lower beam and upper beam.

In this respect, spaces are preferably arranged between the frame units. These spaces can, for example, also be used to provide handling devices for the flat material during bending which engage in the spaces and can thus be designed in a simple manner such that they can advantageously grip the flat material and position it for bending.

With respect to the design of the frame units themselves, it is favorable when each frame unit has a guide means for a defined movement of the lower beam and the upper beam relative to one another so that the guidance of upper beam and lower beam relative to one another is brought about each time at each of the frame units. The lower beam and the upper beam can also be designed in a constructionally advantageous manner, in particular, as a result of the plurality of frame units since the frame units each represent a stabilization of lower beam and upper beam relative to one another and so the stability of the lower beam and the upper beam in longitudinal direction of the bending edge has to be far less great than in machines, with which lower beam and upper beam extend self-supportingly between lateral frame units of the machine frame.

The guide means for lower beam and upper beam relative to one another can be of any optional design. For example, a linear guide means for moving the lower beam and the upper beam relative to one another would be conceivable.

It is, however, particularly simple from a constructional point of view when the lower beam and the upper beam are pivotable relative to one another about a pivot axis.

In this respect, the pivot axis is preferably located such that it is arranged at a distance from the clamping tools on a side thereof located opposite the bending tool.

A particularly advantageous constructional solution results when each frame unit has a lower beam carrier and an upper beam carrier which are movable by the guide means relative to one another and bear the lower beam and the upper beam, respectively, so that the guide means can be arranged at a sufficiently large distance from lower beam and upper beam.

In order to form a continuous machine frame from the individual frame units, these are to be connected to one another although they already have a connection to one another via a continuous lower beam and a continuous upper beam. Therefore, it is preferably provided for the lower beam carriers of the frame units to be rigidly connected to one another, wherein a continuous rigid connection between the upper beam carriers of the frame units is preferably provided in addition to the lower beam.

With respect to the drive for moving lower beam and upper beam relative to one another it is necessary for at least one of the frame units to have a drive for a relative movement of the lower beam and the upper beam with respect to one another. This one drive would, in principle, be sufficient.

It is, however, particularly favorable when the machine frame is constructed from individual modules and, in particular, each of the frame units has a drive for the relative movement of the lower beam and the upper beam.

With respect to the association of the bending tool carrier drive units with the machine frame, no further details have so far been given; one advantageous embodiment, for example, provides for a bending tool carrier drive unit for the respective bending tool to be associated with each of the frame units.

In order to obtain sufficient space for flat material to be inserted between the upper beam and the lower beam, it is preferably provided for the frame units to engage on the upper beam and the lower beam on a side facing away from the clamping tools.

A machine frame designed to be free from side columns may be produced particularly favorably with a machine frame consisting of at least two frame units of this type in that the frame units are arranged between lateral end surfaces of the upper beam and the lower beam and thus the machine frame is also automatically open in the area of at least one transverse side in order to insert flat material between the upper beam and the lower beam from this side.

It is particularly favorable for simple bending kinematics when the bending tool has a bending nose with a curved pressure surface for acting upon one side of the flat material. One advantageous embodiment provides for the bending tool to be movable by the bending tool moving device between a starting bending position and an end bending position on a path about the respective bending edge which is predetermined in a defined manner such that the curved pressure surface and the side of the flat material acted upon move relative to one another in the form of an essentially slide-free rolling on one another.

The advantage of this solution is to be seen in the fact that as a result of the use of a curved pressure surface and the rolling of the curved pressure surface on the side of the flat material acted upon bending operations which are gentle for the flat material can be realized, on the one hand, with movements of the bending tool which can be carried out in a technically simple manner.

The advantage of this solution is, moreover, to be seen in the fact that no sliding of the bending tool relative to the flat material essentially takes place, wherein the movement of the bending tool required for this purpose can be realized in a constructionally simple manner.

In principle, it would be conceivable to move the bending tool on the path provided for the inventive solution, for example, by means of numerical path controls. Such a solution does, however, have the disadvantage that large forces have to be generated and controlled exactly for the movement of the bending tool.

For this reason, it is preferably provided for the path of the bending tool to be predetermined in a defined manner by a mechanical path guide means so that no precise path control of the bending tool with the aid of large forces is necessary but merely a driving of the bending tool in such a manner that it follows the path guide means.

The path guide means may be realized in the most varied of ways. For example, it would be conceivable to provide a connecting link path for this purpose which is followed by a path follower. Such a connecting link path is, on the one hand, complicated to produce and, on the other hand, entails a considerable constructional size.

For this reason, one advantageous embodiment provides for the path of the bending tool to be predetermined by at least one pivoting movement. A pivoting movement has the great advantage that this may be realized in a simple manner suitable even for large forces and, in particular, is liable to fewer appearances of wear and tear than a guide means by means of a connecting link path, in a simple manner and without considerable mechanical resources.

The inventive path may be realized particularly favorably when the path of the bending tool is predetermined by way of superposition of at least two pivoting movements, wherein reference is made to the comments made above with respect to the advantage of the pivoting movements in comparison with connecting link guide means.

No further details have so far been given concerning the design and alignment of the bending nose.

One advantageous embodiment, for example, provides for the bending nose to face at least one of the clamping tools with a bending nose tip in all the bending positions, wherein with such an alignment of the bending nose only simple movements thereof are necessary in order to bend the flat material in an inventive manner.

The way, in which the curved pressure surface and the side of the flat material acted upon by the tool are intended to move relative to one another, has not been specified in detail in conjunction with the preceding explanations concerning the invention. It would, for example, be conceivable to configure the rolling along such that a contact line between the pressure surface and the side of the flat material acted upon migrates away from the bending edge.

The movement of the inventive bending nose may be realized particularly favorably when a contact line between the pressure surface and the side of the flat material acted upon moves in the direction of the bending edge on the side of the flat material acted upon during the pass through the bending positions from the starting bending position to the end bending position. This solution has the great advantage that, in relation to the clamping tools, no pivoting of the bending nose itself through large pivoting angles is required in order to fulfill the inventive condition of the essentially slide-free rolling on the side of the flat material acted upon.

With respect to the design of the pressure surface itself, no further details have so far been given. One advantageous embodiment, for example, provides for the pressure surface to have an apex line located closest to the respective clamping tool in the starting bending position and to extend away from the clamping tool proceeding from this apex line. Such a design of the pressure surface of the bending nose likewise offers a simple possibility for being able to carry out the bending of the flat material precisely with movements of the bending tool which are as simple as possible.

A particularly advantageous design of the pressure surface provides for this to have a front pressure surface section which is located so as to face away from the bending tool carrier and extends away from the apex line. Such a type of pressure surface is suitable, in particular, for carrying out bendings of the flat material through angles of up to 90°. It is even more advantageous when the pressure surface has a rear pressure surface section which faces the bending tool carrier and, located opposite the front pressure surface section, extends away from the apex line. Such a design of the pressure surface has the advantage that, in particular, large bending angles, in particular, bending angles of more than 90° can also be realized with a simple movement of the bending tool.

Within the scope of the inventive solution, it is preferably provided for the contact line between the pressure surface and the side of the flat material acted upon to be located in the area of the front pressure surface section in the starting bending position and to move in the direction of the apex line during bending.

In this respect, it is particularly favorable when the bending nose is movable into such an end bending position, in which the contact line is located in the area of the rear pressure surface section so that as large a pressure surface as possible can be utilized during the bending procedure and a bending of the flat material through more than 90° can be carried out, in particular, with simple movement kinematics.

Additional features and advantages of the invention are the subject matter of the following description as well as the drawings illustrating several embodiments:

IN THE DRAWINGS

Figure 1:
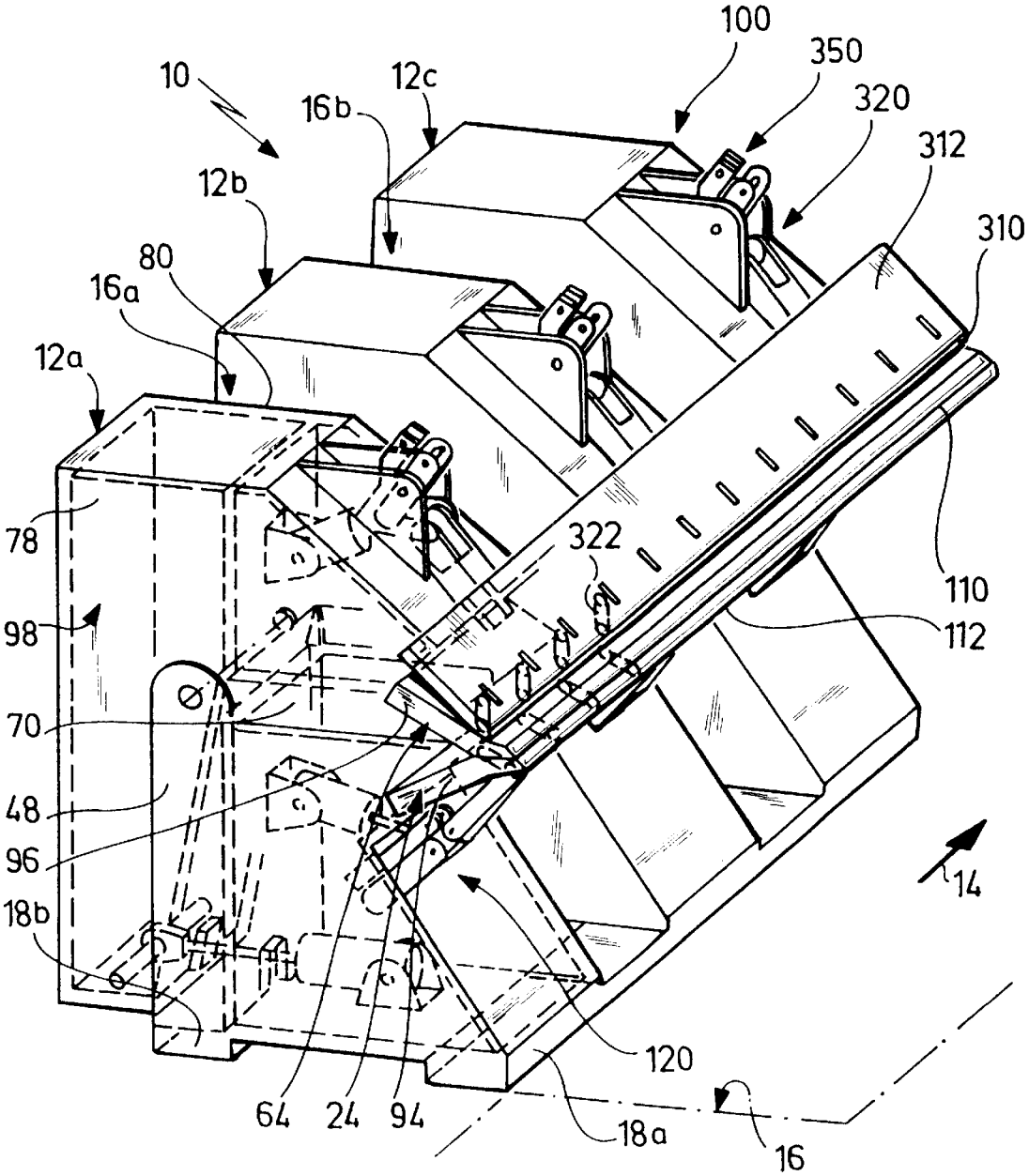
FIG. 1 shows a perspective view of an inventive bending machine.
Figure 2:
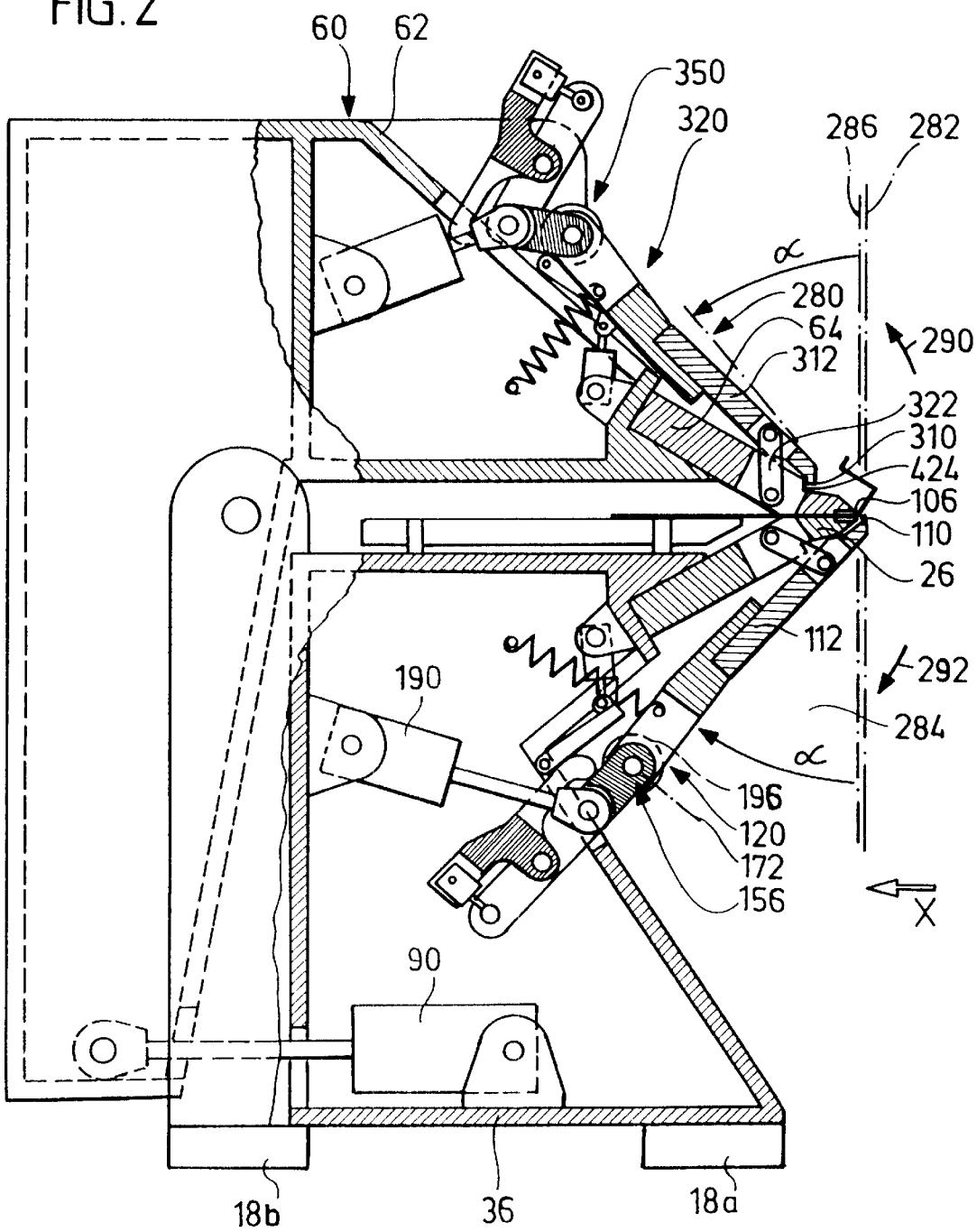
FIG. 2 shows an illustration of a frame unit, partially cutaway in a plane extending at right angles to the bending edge, with flat material clamped.
Figure 3:
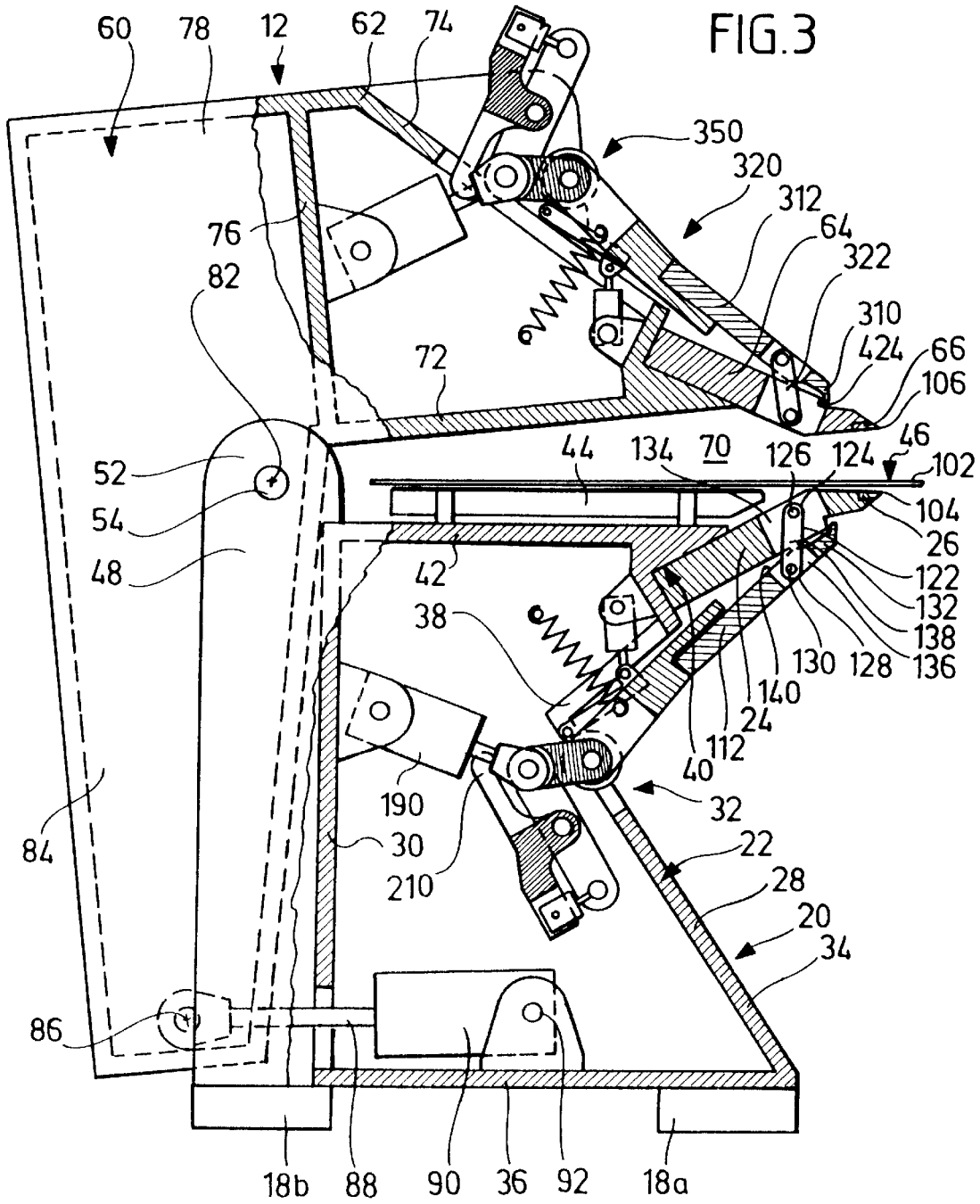
FIG. 3 shows an illustration similar to FIG. 2 with clamping tools moved apart.

One embodiment of an inventive bending machine, illustrated in FIGS. 1 to 3, comprises a machine frame which is designated as a whole as 10 and has a plurality of frame units 12*a* to 12*c* which are arranged so as to follow one another in a longitudinal direction 14 such that spaces 16*a*, 16*b* remain each time between the individual frame units 12*a* and 12*b* as well as 12*b* and 12*c*.

The frame units 12 are rigidly connected to one another, for example, by longitudinal carriers 18*a*, b which rest on a base surface 16 for the bending machine and extend in the longitudinal direction 14 and on which the individual frame units are seated and which also extend beyond the spaces 16. Each of the frame units 12 comprises, as is apparent in FIGS. 1 to 3, a lower beam carrier 20 which rests on the longitudinal carriers 18 and rises above these with a lower beam carrier member 22, on which a lower beam 24 is held which extends over all the frame units 12 in the longitudinal direction 14 and, for its part, bears a lower clamping tool 26.

The lower beam carrier member 22 is constructed such that this has between the lower beam 24 and the front longitudinal carrier 18*a* a front wall 28 which is designed to extend backwards in the direction of a rear wall 30 located opposite it and thus creates a freely accessible front space 32 between the lower beam 24 and the front longitudinal carrier 18*a*. The front wall 28 preferably has a lower area 34 which is inclined in relation to a base part 36 of the lower beam carrier member 22 through an angle of less than 90° and therefore rises proceeding from the front longitudinal carrier 18*a* so as to extend in the direction of the rear wall 30 and then merges into an upper area 38, in which the front wall 28 again extends away from the rear wall 30 in the direction of the lower beam 24 as far as a section 40 of the lower beam carrier member 22 accommodating the lower beam 24. The lower beam carrier member 22 is preferably provided, in addition, with an upper part 42 which bears a support 44 for flat material 46 to be bent.

Furthermore, the lower beam carrier 20 is provided, in addition, with two side walls 48 and 50 which are arranged at a distance from one another, project beyond the rear wall 30 and also preferably beyond the upper part 42 and in a projecting area 52 support a pivot bearing 54, with which an upper beam carrier 60 is mounted to as to be pivotable in relation to the lower beam carrier 20.

The upper beam carrier 60 comprises an upper beam carrier member 62 which, for its part, supports an upper beam 64 with an upper clamping tool 66, wherein the upper beam 64 with the upper clamping tool 66 is located on a side of a workpiece accommodating space 70 located opposite the lower beam 24 with the lower clamping tool 26, the flat material being positionable in this workpiece accommodating space in order to clamp this between the upper clamping tool 66 and the lower clamping tool 26 for bending.

The upper beam carrier member 62 is preferably designed such that it has a lower part 72, which extends on a side of the workpiece accommodating space 70 located opposite the upper part 42 of the lower beam carrier member 22, and a front wall 74 which rises above the lower part 72 extending at an acute angle thereto and extends as far as a rear wall 76 which connects the lower part 72 to the front wall 74.

Furthermore, the upper beam carrier member 62 comprises oppositely located side walls 78, 80 which extend beyond the upper beam carrier member 62, thereby extend between the side walls 48, 50 in their area projecting beyond the lower beam carrier member 22 and engage on the pivot bearing 54 in order to mount the entire upper beam carrier member 62 so as to be pivotable about a pivot axis 82 of the pivot bearing 54 in relation to the lower beam carrier member 22.

The side walls 78 and 80 preferably extend with lower areas 84 in the direction of the rear longitudinal carrier 18*b* and hold a bearing 86, on which a drive 90 engages which, for its part, is mounted in the lower beam carrier member 22 by means of a bearing 92 and acts on the bearing 86, for example, by means of a drive rod 88.

The drive 90 serves to pivot the upper beam carrier member 62 about the pivot axis 82 relative to the lower beam carrier member 22 and thus move the upper beam 64 with the upper clamping tool 66 away from the lower beam 24 with the lower clamping tool 26 in order to release the clamping of the flat material 46 and subsequently to again clamp this or further flat material between the clamping tools 26, 66.

The drive 90 is preferably designed as an actuating cylinder which can be actuated either hydraulically or pneumatically.

Figure 4:
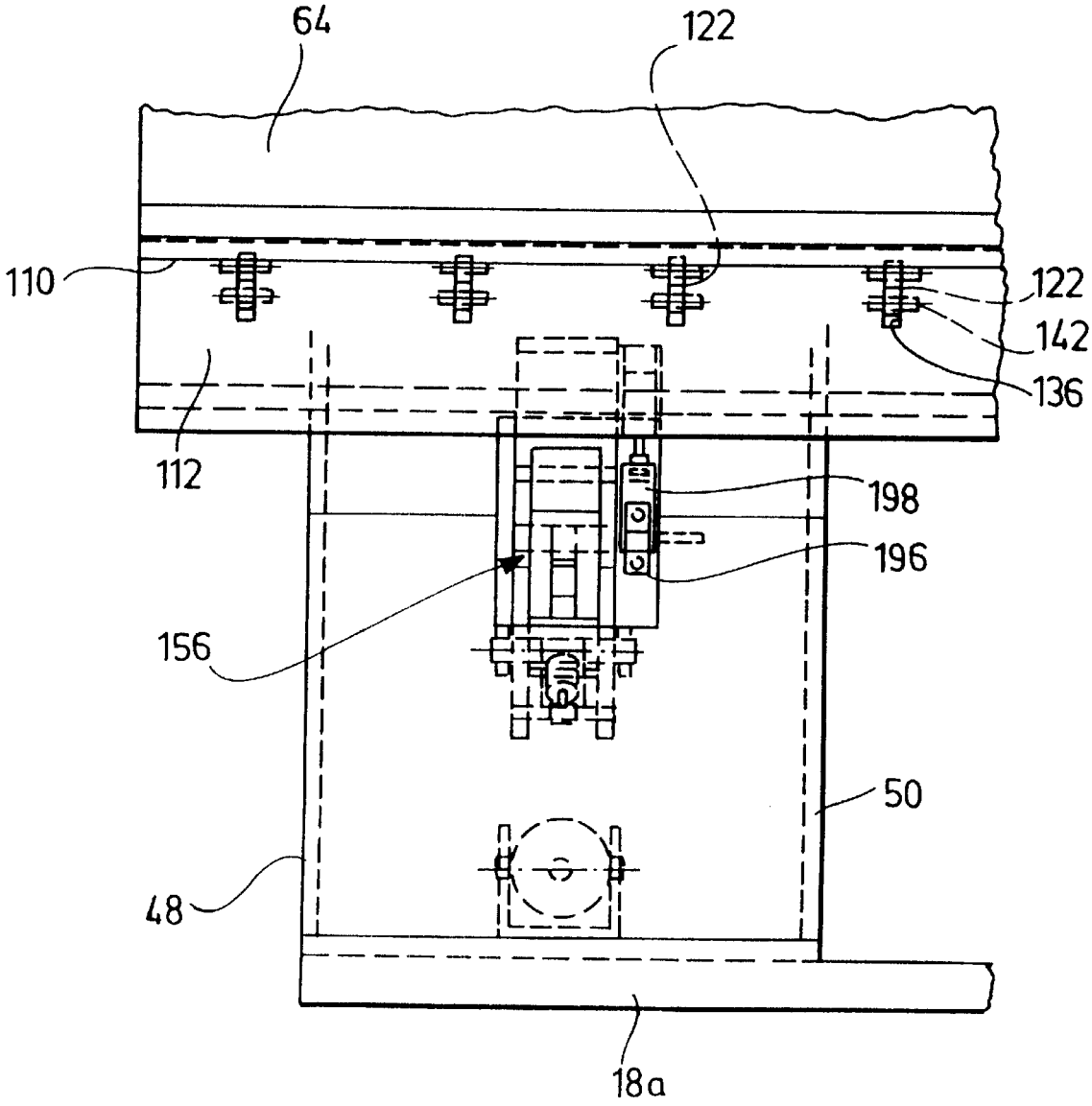
FIG. 4 shows a front view in the direction of arrow X in FIG. 2.

As illustrated in FIGS. 1 and 4, not only the lower beam 24 but also the upper beam 64 extend in the longitudinal direction 14 over the entire length of the bending machine in this direction and each preferably beyond the outer frame units 12*a* and 12*c* so that all the frame units 12*a*, 12*b* and 12*c* are located within lateral end surfaces 94 of the lower beam 24 and 96 of the upper beam 64, and the workpiece accommodating space 70, insofar as it extends in the direction of the clamping tools 26 and 66 proceeding from an area located close to the pivot bearing 54, is freely accessible from transverse sides 98, 100 of the machine frame 10 extending transversely to the longitudinal direction 14 so that from the transverse sides 98, 100 a supply of the flat material 46 can be fed into the workpiece accommodating space 70 and also directly between the clamping tools 26, 66, for example, with a section 102 to be bent over and projecting on the front side.

In order to bend the section 102 of the flat material 46 to be bent over, the flat material is clamped between the clamping tools 26, 66, wherein each of the clamping tools 26, 66 determines a bending edge 104 and 106, respectively, which extends parallel to the longitudinal direction 14 and about which the section 102 of the flat material 46 to be bent over can be bent over when this bending edge is operative.

The section 102 to be bent over is bent over, as illustrated in FIG. 2, for example, by means of a lower bending tool 110 which is held on a lower bending tool carrier 112, wherein the lower bending tool 110 extends in the longitudinal direction 14 and the lower bending tool carrier 112 preferably extends in longitudinal direction 14 over the entire length of the lower beam 24.

Figure 5:
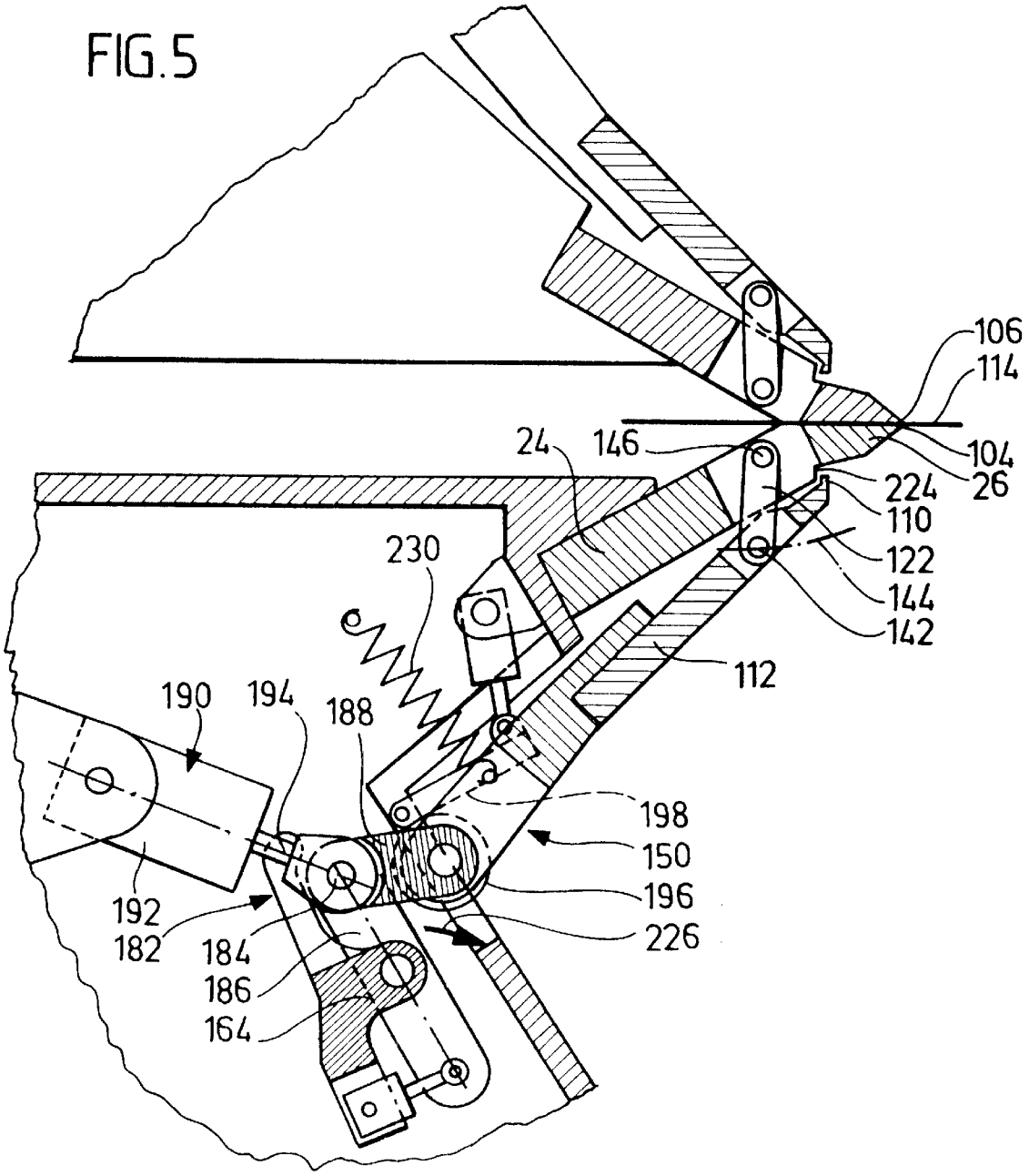
FIG. 5 shows an enlarged sectional illustration of lower beam, upper beam, bending tool, bending tool carrier and bending tool moving device with a bending tool in rest position.
Figure 6:
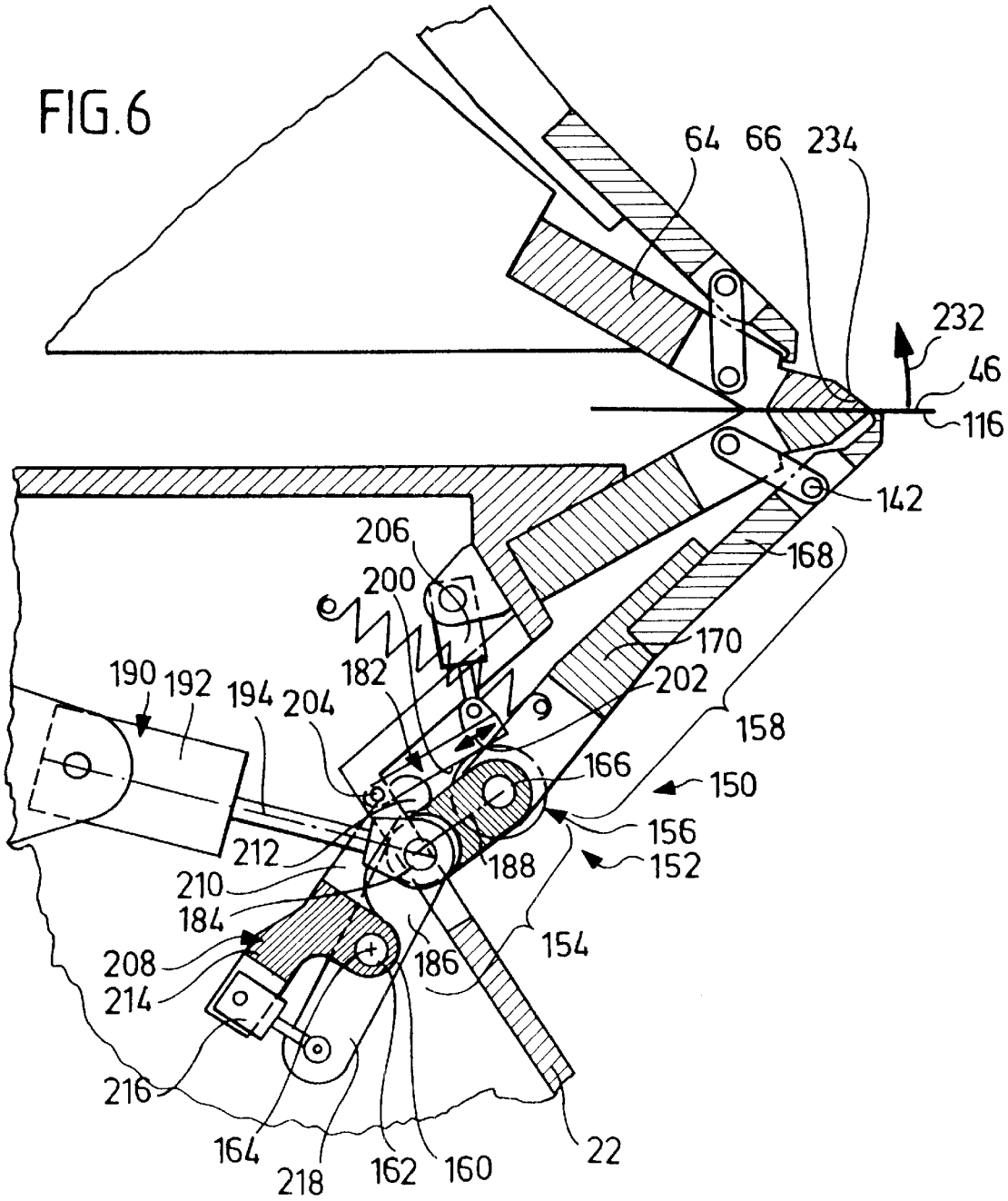
FIG. 6 shows an illustration similar to FIG. 5 with a bending tool in a starting bending position.
Figure 7:
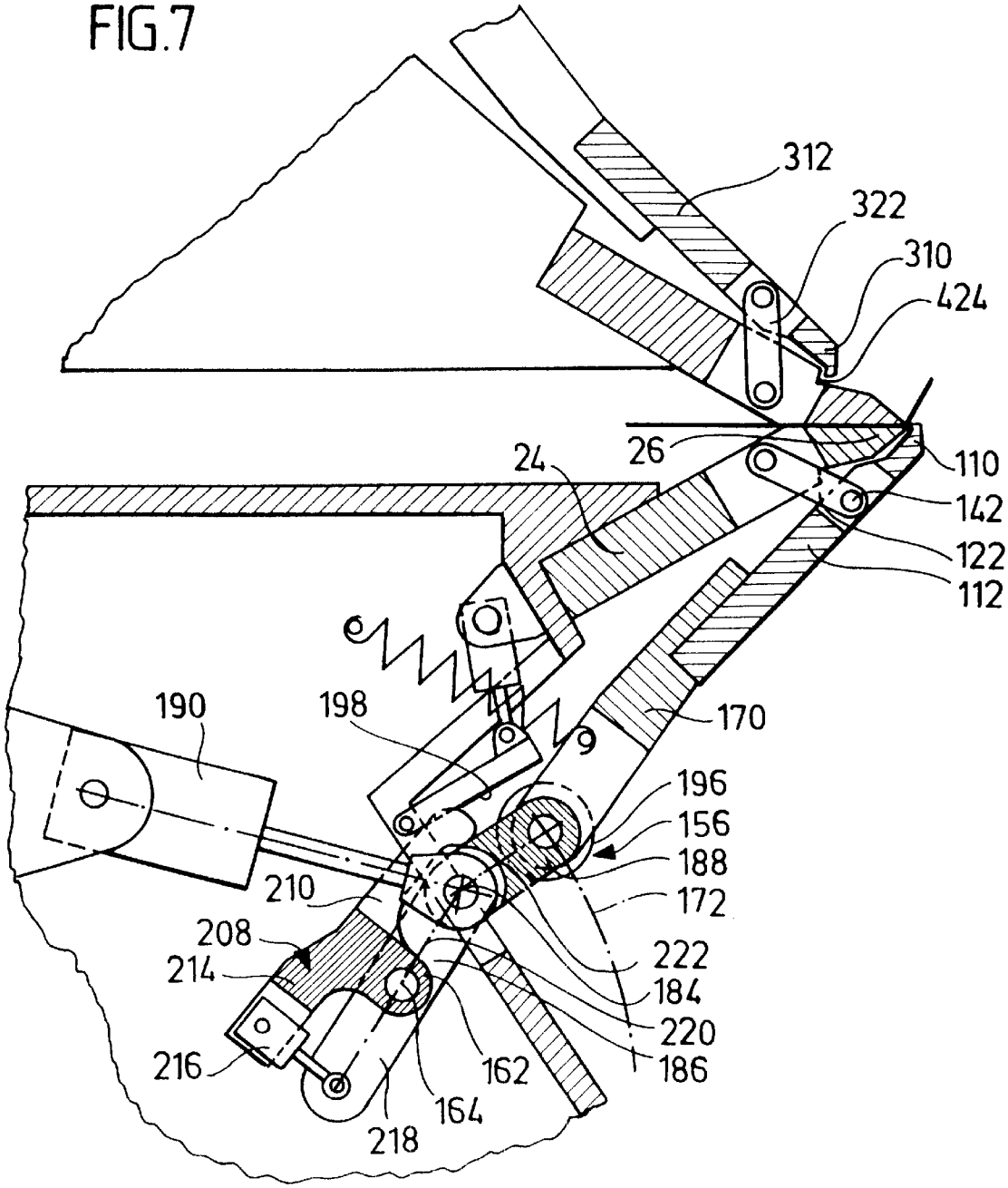
FIG. 7 shows an illustration similar to FIG. 5 with a bending tool in a bending position following the starting bending position.
Figure 8:
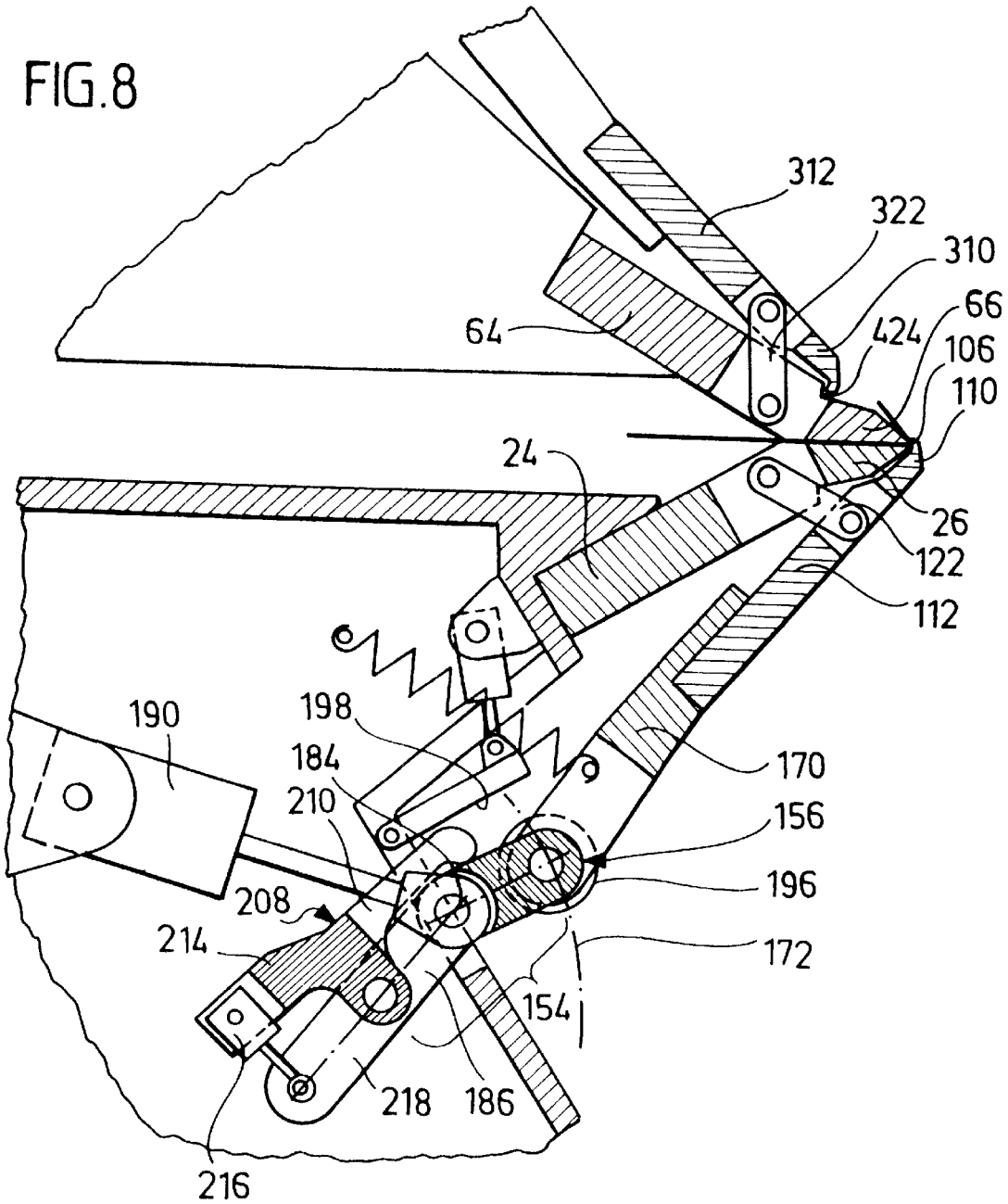
FIG. 8 shows an illustration similar to FIG. 5 with a bending tool in an end bending position.

In this respect, for the bending the lower bending tool 110, proceeding from a rest position illustrated in FIG. 5, in which the bending tool 110 is in a rest position withdrawn in relation to the bending edge 104 of the lower clamping tool 26, can be moved in the direction of a clamping plane 114 for the flat material 46 first of all into a starting bending position illustrated in FIG. 6, in which the bending tool 110 abuts on an underside 116 of the flat material 46, and can then be moved further into bending positions illustrated in FIG. 7 and FIG. 8, whereby a bending about the operative bending edge 106 of the upper clamping tool is brought about as far as the end bending position illustrated by way of example in FIG. 8.

In order to move the lower bending tool 110, a bending tool moving device designated as a whole as 120 is provided. The bending tool moving device comprises, as illustrated in FIGS. 1 to 8, a plurality of holding connection bars 122 which are arranged at a distance from one another in the longitudinal direction 14 and are mounted in the area of a first end 124 by means of a pivot bearing 126 so as to be pivotable on the lower beam and in the area of a second end 128 by means of a pivot bearing 130 in an area 132 of the lower bending tool carrier 112 located close to the bending tool 110.

The first end 124 of each of the holding connection bars 122 is preferably located in a recess 134 of the lower beam 24 such that the holding connection bar 122 projects beyond the recess 134 at least with its second end 128 and engages in a recess 136 in the area 132 of the bending tool carrier 112, wherein the pivot bearing 130 mounting the second end 128 is likewise preferably arranged in the recess 136.

As a result, the holding connection bar 122 is located with its respective ends 124 and 128 in the recesses 134 and 136, respectively, of the lower beam 24 and the bending tool carrier 112, respectively, and the holding connection bar 122 extends with a central area 138 located between the ends 124 and 128 over a space 140 between the lower beam 24 and the lower bending tool carrier 112.

As a result of the pivot bearings 126 and 130, a point of engagement of the respective holding connection bar 122 on the bending tool carrier 112 which is defined by a pivot axis 142 of the pivot bearing 130 is guided around a pivot axis 146 of the pivot bearing 126 on a path 144, wherein the path 144 represents a circular path with respect to a center point fixed in relation to the machine frame.

The holding connection bars 122 are preferably arranged at constant distances from one another distributed over the entire length of the bending tool carrier 112 and mount this so as to be movable in relation to the lower beam 24, wherein the plurality of holding connection bars 122 represents for the bending tool carrier 112 in the area 132, on account of the multiple support in relation to the lower beam 24, an improved bowing rigidity against any bowing of the bending tool carrier 112 under load with a partial increase in the size of the space 140 so that, as a result, the entire bending tool carrier 112 is held in a defined manner in relation to the lower beam 24 whilst maintaining a constant space 140 between the carrier and the lower beam 24 and thus the lower beam 24 likewise stabilizes the bending tool carrier 112 on account of its own bending rigidity against any bowing under load.

The distance between successive holding connection bars 122 in longitudinal direction 14 is preferably less than 50 cm.

In order to move the bending tool carrier 112, the bending tool moving device 120 comprises, in addition, several bending tool carrier drive units 150, wherein one bending tool carrier drive unit 150 is preferably associated with a respective one of the frame units 12.

Each bending tool carrier drive unit 150 comprises, as illustrated in FIGS. 6 to 8, an elbow lever drive system 152 which, for its part, is formed by a drive arm 154 forming a first lever and an arm 158 connected to it via an elbow joint 156 and forming a second lever.

The drive arm 154 is, for its part, mounted in a first bearing area 160 via a pivot bearing 162 so as to be pivotable about an axis 164 in relation to the lower beam carrier member 22, wherein the pivot bearing 162 engages on the lower beam carrier member 22 so that the pivot axis 164 is arranged so as to be stationary in relation to the lower beam carrier member 22 and thus in relation to the machine frame.

Furthermore, the drive arm 154 is pivotally connected to the arm 158, which extends from the elbow joint 156 as far as the pivot axis 142 of the pivot bearing 130, in a second bearing area 166 via the elbow joint 156. The arm 158 is thereby formed partially by a section 168 of the lower bending tool carrier 112 extending from the pivot axis 142 in the direction of the elbow joint 156 and an arm extension 170 adjoining this section 168.

As a result of the drive arm 154, the point of engagement on the arm 158 defined by the elbow joint 156 is movable on a circular path 172 about the axis 164 and, as a result, a movement of the lower bending tool 110 can be determined which is also determined, in addition, by the path 144 of the point of engagement 142 of the holding connection bars 122 on the bending tool carrier 112 and the lever length between the elbow joint 156 and the point of engagement 142 as well as the distance of the bending tool 110 from the point of engagement 142.

Furthermore, the drive arm 154 is designed to be variable in length by varying a distance between the pivot bearing 162 and the elbow joint 156, namely by means of an elbow lever mechanism 182 which is formed by a first arm section 186 extending from the first bearing area 160 as far as the center joint 184 of the drive arm 154 and a second arm section 188 extending from the center joint 184 as far as the elbow joint 156 of the elbow lever drive system 152.

For driving the drive arm 154, a pivot drive 190 engages on the center joint 184 thereof, this pivot drive being designed, for example, as an adjusting cylinder 192 and acting on the center joint 184 via an actuating rod 194, wherein the actuating rod likewise preferably engages on the center joint 184 in an articulated manner.

In addition, the elbow joint 156 is provided with a path follower 196 in the form of a roller which can be abutted on a connecting link path designated as a whole as 198 in all the elbow joint positions of the elbow lever mechanism 182 up to reaching an extended position, wherein the connecting link path 198 is formed by a guide rail, against which the path follower 196 designed as a roller can be abutted and is movable along a surface 200, preferably designed as a plane, in longitudinal direction 202 of the connecting link path 198. The connecting link path 198, for its part, is again pivotally mounted on the lower beam carrier member 22 via a joint 204 at an end facing the front wall 28 of the lower beam carrier member 22 and, on the other hand, can be adjusted via an adjusting drive 206 in the direction of the path follower 196 or away from it so that, depending on the setting of the connecting link path 198, the path follower 196 comes to rest on the connecting link path 198 in different positions of the elbow lever drive system 152 when a defined length adjustment of the drive arm 154 is the starting point.

Furthermore, a blocking device which is designated as a whole as 208 is provided for the length adjustment of the drive arm 154, this blocking device being in a position to block the elbow lever mechanism 182 provided for the length adjustment of the drive arm 154 in different extended positions.

The blocking device 208 preferably comprises a blocking lever 210 which is mounted on the first arm section 186 so as to be pivotable relative to this about the pivot axis 164. The blocking arm 210 further comprises a blocking finger 212 which extends in the direction of the first arm section 186 and beyond this and the center joint 184 and which can be abutted on the second arm section 188.

Furthermore, the blocking arm 210 comprises a drive arm 214 which extends beyond the pivot axis 164 on a side located opposite the blocking finger 212 and is connected, for its part, to an adjusting drive 216, wherein the adjusting drive 216 acts on a support arm 218 which is connected to the first arm section 186 in one piece but extends beyond the pivot bearing 162 in the opposite direction to the first arm section and extends parallel to the drive arm 214 of the blocking arm 210. The adjusting drive 216 serves to pivot the blocking finger 212 relative to the first arm section 186 into different positions so that the blocking finger 212 comes to rest on the second arm section 188 in different extended positions of the second arm section 188 relative to the first arm section 186 and blocks any extended position of the second arm section 188 relative to the first arm section 186 which goes beyond this extended position.

In a first extended position, for example, illustrated in FIGS. 6 to 8, a connecting line 220 between the pivot bearing 162 and the center joint 184 extends at an angle of less than 1800 in relation to a connecting line 222 between the center joint 184 and the elbow joint 156 and so the drive arm 154 has a length which is defined by the distance between the pivot bearing 162 and the elbow joint 156 and which is smaller than the maximum length which can be set by the elbow lever mechanism 182 and is given when the connecting line 220 between the pivot bearing 162 and the center joint 184 is flush with the connecting line 222 between the center joint 184 and the elbow joint 156.

This second extended position is illustrated, for example, in FIG. 2.

The blocking device 208 of the elbow lever mechanism 182 is, in addition, arranged such that the position of the blocking device 208 does not prevent any bending of the elbow lever mechanism into a bent position during the movement of the center joint 184 in the direction of the pivot drive 190 and so during the movement of the center joint 184 in the direction of the pivot drive 190 a minimum length of the drive arm 154 illustrated in FIG. 5 can be reached.

In the case of the minimum length of the drive arm illustrated in FIG. 5, at which the connecting lines 220 and 222 form with one another an angle of preferably less than 90°, the lower bending tool 110 is in its maximum withdrawn or rest position, in which the bending tool 110 is preferably located in a recess 224 provided for this purpose which is provided in the lower beam 24 for accommodating the bending tool 110 in the rest position. In the rest position, the holding connection bars 122 are at the same time in a position which is inclined to a considerable extent in relation to the lower beam 24 and also to the bending tool carrier 112 and so the lower bending tool carrier 112 is located as close as possible to the lower beam 24 with its area extending over this beam. Furthermore, in the rest position the elbow joint 156 is supported on the connecting link path 198 via the path follower 196, wherein as a result of the path follower 196 being supported on the connecting link path 198 the bending of the elbow joint mechanism 182 is brought about due to pivoting of the first arm section 186, in particular, due to pull on the center joint 194 on account of no stabilization of the elbow lever mechanism 182 against any such bending.

If, proceeding from the rest position illustrated in FIG. 5, the elbow lever mechanism 182 is now moved in the direction of its extended position by the pivot drive 190 due to pivoting of the first arm section 186 about the pivot axis 164, the path follower 196 migrates along the connecting link path 198 whilst the elbow lever mechanism 182 stretches in the direction of the lower beam 24, wherein the path follower 196 is held in abutment on the connecting link path 198 due to the fact that a biasing means 230, preferably a spring-elastic element, engages in addition on the arm 158 and acts on this preferably in the area of the arm extension 170 in such a manner that the path follower 196 is held in abutment on the connecting link path 198 for such a time as the elbow lever mechanism 182 has not yet reached its extended position. As a result, the bending tool 110, as illustrated in FIG. 6, migrates out of the recess 224 in the direction of the clamping plane 114 and, as illustrated in FIG. 6, comes to rest on the flat material 46 located in the clamping plane 114 and fixed by the clamping tools 26, 66, wherein the starting bending position is reached when the bending tool 110 touches the underside 116 of the flat material 46.

The connecting link path 198 is preferably adjusted by the adjusting drive 206 such that in the starting bending position the path follower 196 still rests on the connecting link path 198 but in the starting bending position, as well, the extended position of the elbow lever mechanism 182 predetermined by the blocking device 208 is reached and so the drive arm 154 has the maximum length provided for the bending operation and thus the path of the bending tool.

As a result of the blocking of the elbow lever mechanism 182 in the extended position predetermined by the blocking device 208, any further movement of the first arm section 186 in the pivoting direction 226 leads to a pivoting of the drive arm 154 in pivoting direction 226 as a whole, whereby after the starting bending position of the bending tool 110 has been reached the path follower 196 also lifts away from the connecting link path 198 and moves in accordance with the path 172 of the elbow joint 156, namely contrary to the action of the biasing means 230. As a result, the bending tool 110 moves into the subsequent bending positions and acts against the underside 116 of the flat material 46 in such a way that this is bent upwards out of the clamping plane 114, i.e., in the direction of the upper beam 64 in a first bending direction 232.

The bending of the flat material 46 can, as illustrated in FIG. 8, be brought about for such a time until the flat material 46, as illustrated in FIG. 8, abuts on an inclined front surface 234 of the upper clamping tool 66 extending at an acute angle in relation to the clamping plane 114.

During the transfer of the bending tool 110 from the rest position into the starting bending position as a result of transfer of the elbow lever mechanism 182 from the bent position into the extended position, the holding connection bars 122 are moved along the path 144 at the same time from their rearwardly pivoted position, in which the pivot axis 142 has the greatest distance from the lower clamping tool 26, into their forwardly pivoted position, wherein in the forwardly pivoted position the pivot axis 142 is located close to the lower clamping tool 26. After reaching the starting bending position, only an essentially slight, additional movement of the holding connection bars 122 takes place in the direction of the lower clamping tool 26 for such a time until the elbow lever drive system 152 has reached its maximum extended position and, subsequently, a slight movement again backwards after leaving the maximum extended position of the elbow lever drive system 152. However, after reaching the starting bending position, illustrated in FIG. 6, a pivoting of the bending tool carrier 112 about the pivot axis 142 essentially takes place on account of the movement of the elbow joint 156 on the path 172 and so the bending tool 110 arranged at a distance from the pivot axis 142 on a side thereof located opposite the elbow joint 156 likewise performs a corresponding movement on a circular path about the pivot axis 142 which is, however, not arranged so as to be fixed in relation to the machine frame in order to reach the additional bending positions.

Figure 9:
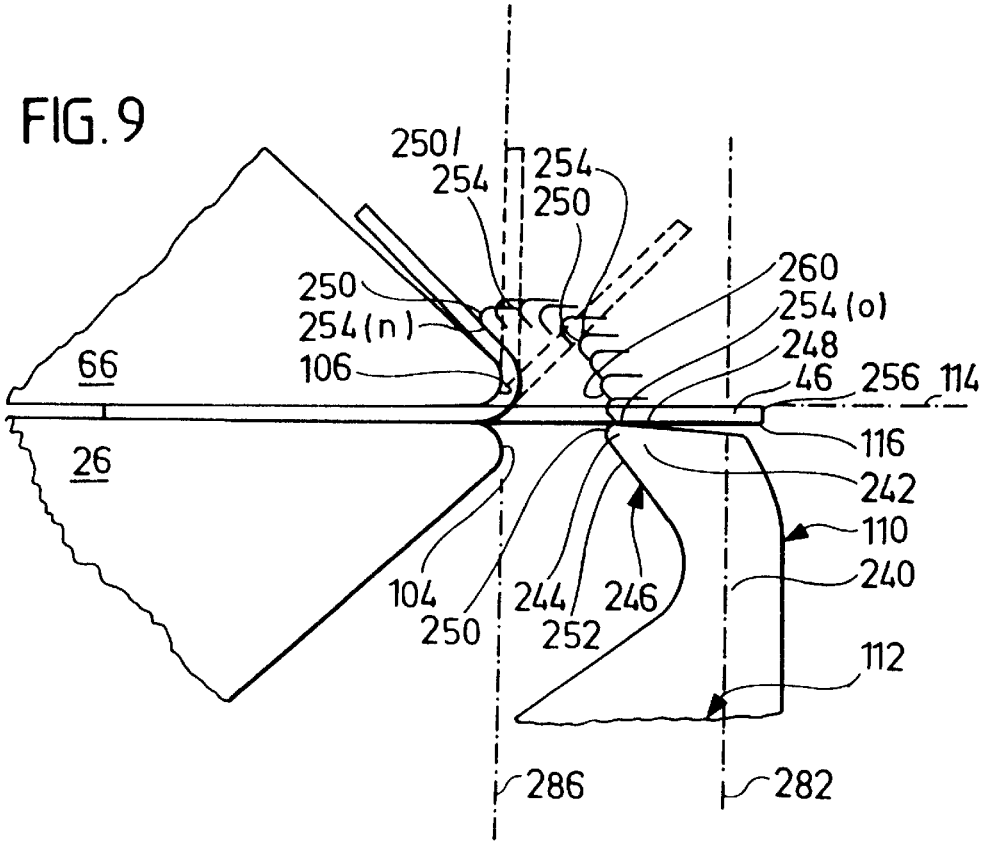
FIG. 9 shows an enlarged sectional illustration of individual bending positions with a first distance from the bending edge.

The carrying out of a bending operation is explained again in detail in FIG. 9. As illustrated in FIG. 9, the bending tool 110 has a neck 240 which adjoins the bending tool carrier 112. The neck 240 bears, for its part, a bending nose 242 which serves for actually carrying out the bending operation. The bending nose 242 extends, proceeding from the neck 240, in the direction of the clamping tools 26, 66 such that a bending nose tip 244 is always facing at least one of the clamping tools 26, 66 and proceeding from the bending nose tip the bending nose 242 extends away from the respective clamping tool 26 and/or 66. Furthermore, the bending nose 242 bears a pressure surface which is designated as a whole as 246 and with which the underside 116 of the flat material 46 can be acted upon. The pressure surface 246 thereby comprises an upper pressure surface section 248 which is arranged to face away from the bending tool carrier 112 and with which the bending nose 242 first touches the underside 116 of the flat material 46 in the starting bending position. The front pressure surface section 248 extends in a curve as far as an apex line 250 located on the bending nose tip 244. Proceeding from the apex line 250, a rear pressure surface section 252 of the pressure surface 246 extends away from the bending nose tip 244 on a side of the bending nose 242 facing the bending tool carrier 112.

The abutment of the bending nose 242 on the, in this case, underside 116 of the flat material 46 is an essentially linear abutment which is predetermined by a contact line 254 which extends parallel to the longitudinal direction 14 and thus also in longitudinal direction of the bending tool 110. In the starting bending position, the contact line 254, as illustrated in FIG. 9, abuts on the front pressure surface section 248, namely at a maximum distance from the apex line 250. If, proceeding from the starting bending position, the flat material 46 is now bent out of the clamping plane 114, the contact line 254 migrates on the front pressure surface section 248 in the direction of the apex line 250 and coincides with the apex line 250 when the flat material 46 has been bent out of the clamping plane 114, for example, through an angle in the order of magnitude of 90°. During further bending of the flat material 46 beyond this angle, the contact line 254 runs beyond the apex line 250 and then migrates onto the rear pressure surface section 252, on which it abuts in all the bending positions, in which a bending over of the flat material 46 in relation to the clamping plane 114 through an angle of more than 90° takes place.

In order to ensure that during the migration of the contact line 254 from the starting bending position, in which the contact line 254 is designated as 254(o), as far as the end bending position, in which the contact line is designated as 254(n), the bending nose 252 runs along on the underside 116 of the flat material, it has to be taken into consideration during the movement of the bending nose 242 that the contact line 254 migrates in the direction of the bending edge, in this case the bending edge 106, in relation to an end edge 256 of the flat material 46 when the bending nose 242 is intended exclusively to roll along on the underside 116 of the flat material 46 without any relative sliding movement. This movement of the contact line 254 relative to the end edge 256 is to be taken into consideration for the path of movement 260, along which the bending nose 242 passes whilst passing through the individual bending positions and so the path 260 deviates from a circular path in adaptation to the cross sectional shape of the bending nose 242.

The determination of the path 260, with which the bending nose 242 moves from the starting bending position as far as the end bending position, is brought about by a suitable determination of the dimensions of the elbow lever drive system 152, in particular, the lengths of the drive arm 154 and the arm 158 as well as the dimensioning of the holding connection bars 122 as well as the distance of the bending nose 242 from the pivot axis 142.

Figure 10:
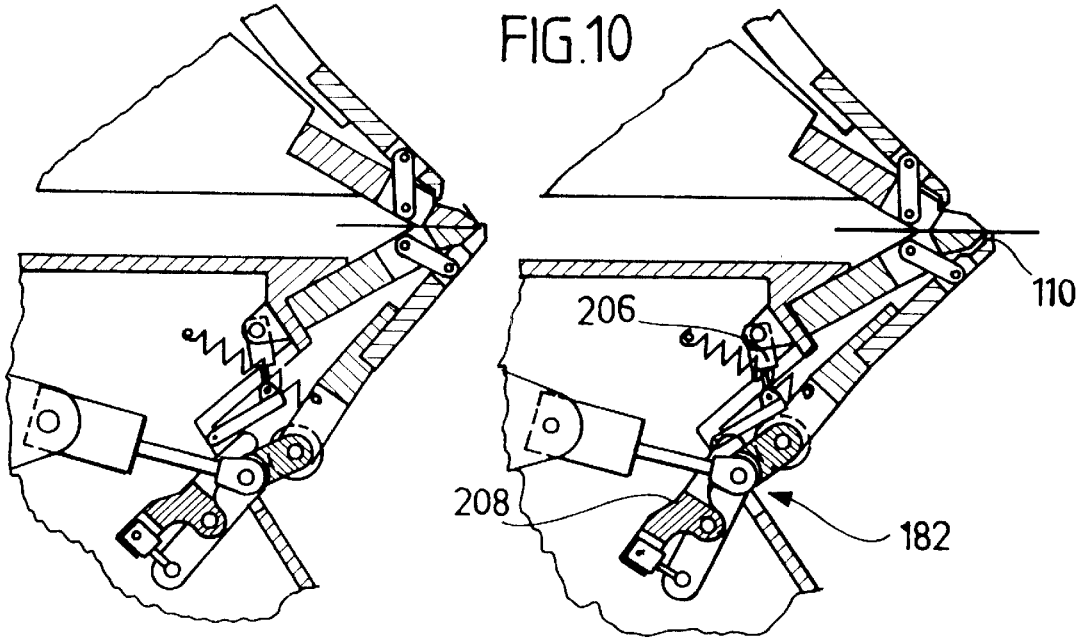
FIG. 10 shows an illustration of the bending tool moving device similar to FIG. 6 of the starting bending position with the first distance from the operative bending edge according to FIG. 9.
Figure 11:
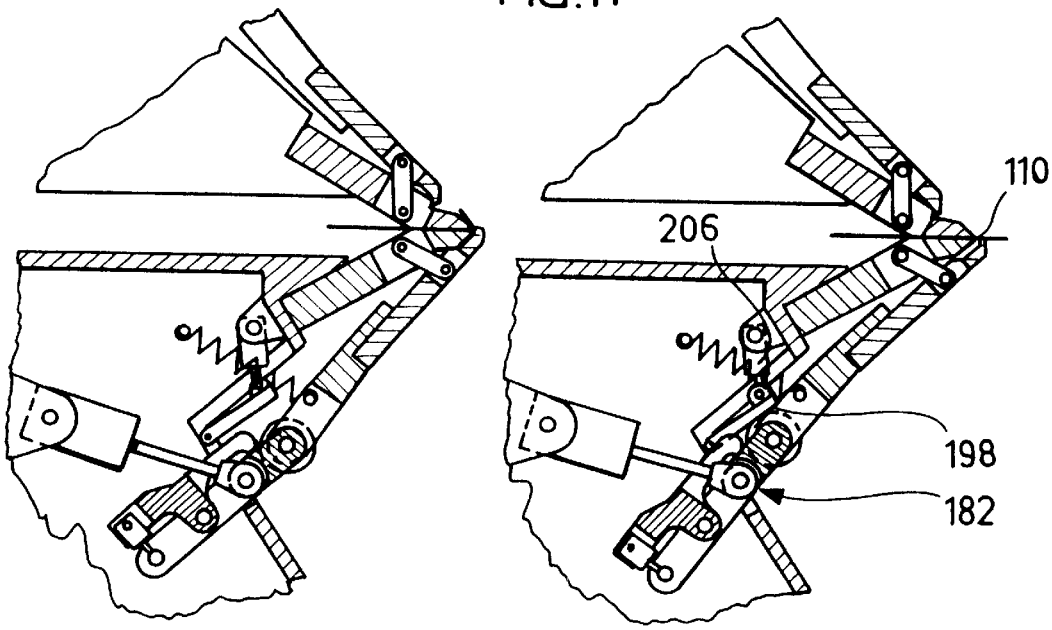
FIG. 11 shows an illustration similar to FIG. 10 with a second distance from the operative bending edge.

The blocking device 208, as already described, allows different extended positions of the elbow lever mechanism 182 to be set, as clearly illustrated again in FIGS. 10 and 11.

In the first extended position, illustrated in FIG. 10, the elbow lever mechanism 182 is not in its maximum extended position but has a length which is smaller than the maximum possible length whereas, for example, in the second extended position illustrated in FIG. 11 the length of the elbow lever mechanism 192 is its maximum.

An adjustment of the connecting link path 198, along which the path follower 196 moves until the respective extended position is reached, is, however, also necessary in accordance with the extended position of the elbow lever mechanism 182 since the bending tool 110 is intended to be in the respective starting bending position when the extended position respectively predetermined by the blocking device 208 is reached. For this reason, the connecting link path 198 is adjusted with the adjusting drive 206 in the second extended position of the elbow lever mechanism 182 such that this path is located closer to the upper area 38 of the front wall 28 of the lower beam carrier member 22 than in the first extended position.

Figure 12:
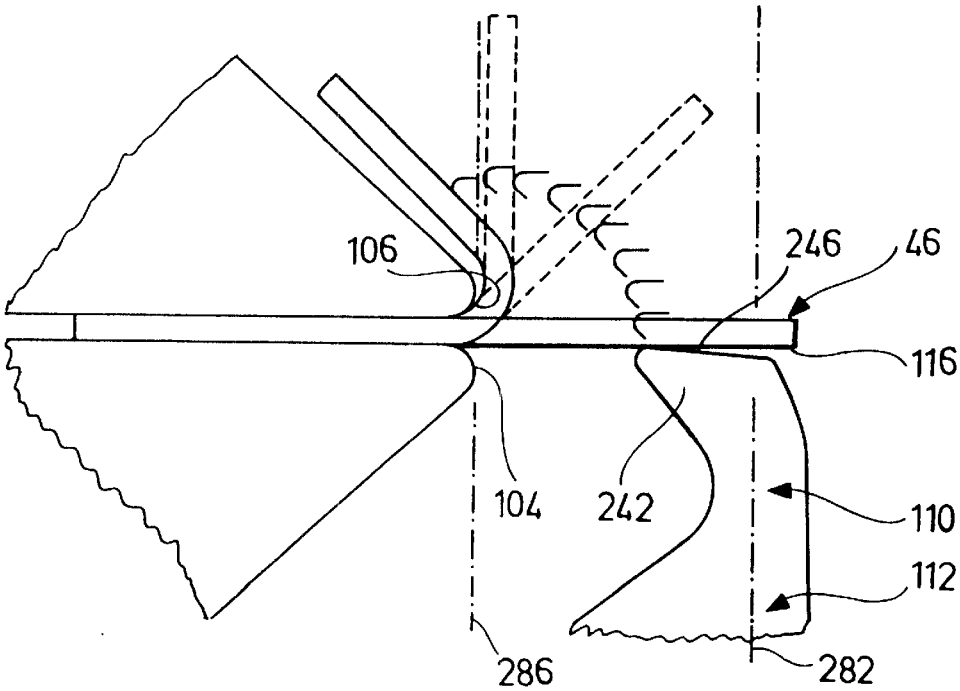
FIG. 12 shows an illustration of individual bending positions with the second distance from the operative bending edge according to FIG. 11.

As a result, it is possible for the bending tool 110 with the bending nose 242 to abut on the underside 116 of the flat material 46 in the starting bending position at a greater distance from the bending edge 106, as illustrated in FIG. 12.

If a bending of the flat material 46 thus takes place in the second extended position of the elbow lever mechanism 182, the bending nose 242 with its pressure surface 246 acts on the flat material 46 at a greater distance from the operative bending edge 106 which is of advantage, in particular, in the case of greater material thicknesses.

The inventive bending machine does, however, comprise not only the lower bending tool 110 and the lower bending tool carrier 112 with an associated bending tool moving device 120 but, in addition, an upper bending tool 310 which is held on an upper bending tool carrier 312, wherein the upper bending tool 310 is movable by means of a bending tool moving device 320 which is designed in the same, preferably identical way as the bending tool moving device 120.

The bending tool moving device 320 likewise comprises, in particular, holding connection bars 322 which function in the same way as the holding connection bars 122 and, in this case, engage on the upper beam 64. In addition, the bending tool carrier drive units 350 are also designed in the same way as the bending tool carrier drive units 150 but, in this case, are arranged on the upper beam carrier member 62.

The upper bending tool 310 is thereby in a position to carry out the same bending operations as those which have been described in conjunction with the lower bending tool 110.

If, as illustrated in FIG. 2, a bending operation is carried out, for example, with the lower bending tool 110, the upper bending tool 310 is in the rest position, in which it engages in a recess 424 in the upper beam 64 corresponding to the recess 224. As a result of the fact that in the rest position the upper bending tool 310, the upper bending tool carrier 312 and also the upper bending tool moving device 320 are located close to the upper beam 64 and close to the front wall 74 of the upper beam carrier member 62, a bending space 280 exists above the operative bending edge 106 between the upper bending tool moving device 320, the upper bending tool carrier 312 as well as the upper bending tool 310 and the clamping plane 114 which extends over an angular area a of approximately 135° proceeding from the clamping plane 114. For this purpose, the front surface 234 of the clamping tool 66 has also to be of an inclined configuration in relation to the clamping plane 114 such that this is likewise inclined through the angle a in relation to the clamping plane 114.

A bending of the flat material 46 through an angle of up to 135° in relation to the clamping plane 114 is thus possible with the lower bending tool 110.

Moreover, the lower bending tool carrier 112 does not move in the form of a pivoting movement about the operative bending edge 106—as is the case in the state of the art—but in all the possible bending positions of the lower bending tool 110 remains in an action space located between the lower beam carrier 20 and a front limiting plane 282 extending at right angles to the clamping plane 114 and through the lower bending tool 110 and the bending tool moving device 120 also remains in this action space without reaching beyond it and so the flat material 46 can, for example, be easily handled as a result or a linking of several machines is possible in a simple manner.

The action space is preferably even smaller and located between the lower beam carrier 20 and a front plane 286 extending through the respectively operative bending edge 104, 106 as well as at right angles to the clamping plane 114.

In addition, the lower bending tool 110 with the bending tool carrier 112 can, however, also be transferred into the rest position which is illustrated, for example, in FIG. 5. A bending space 284, which likewise extends over an angular area $\alpha$ of approximately 135° in relation to the clamping plane 114, also exists between the clamping plane 114 and the lower bending tool moving device 120, the lower bending tool carrier 112 as well as the lower bending tool 110 in this rest position of the lower bending tool 110 and so a bending of the flat material 46 is also possible with the upper bending tool 310 through an angle of up to 135° in relation to the clamping plane 114 about the bending edge 104 of the lower clamping tool 26.

Altogether, a bending of the flat material 46 out of the clamping plane 114 is possible with the inventive bending machine in two opposite directions, namely in direction 290 upwards or in direction 292 downwards out of the clamping plane 114, wherein for bending in direction 290 the lower bending tool 110 can be used and for bending in direction 292 the upper bending tool 310 while the respectively other bending tool 310 or 110 is in a rest position in order to create the respective bending space 280, 284 and the respectively active bending tool carrier 112, 312 remains together with the associated bending tool moving device in the action space between the front plane 286 and the respective beam carrier 20, 60.

The inventive bending machine allows, in particular, the carrying out of multiple bendings of flat material, for example, first of all in direction 290 and subsequently in direction 292 and afterwards, where applicable, again in direction 290, wherein the respective bending spaces 280 and 284 between the front plane 282 and the respectively other bending tool carrier 312 or 112 are of advantage since an additional bending can be carried out without hindrance despite bendings in the same direction already being present.

What is claimed is:

1. A bending machine for flat material, comprising:

a machine frame, a lower beam arranged on the machine frame, said lower beam having a lower clamping tool, an upper beam arranged on the machine frame, said upper beam having an upper clamping tool, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, and the bending tool not used for an operation on the flat material and its corresponding bending tool carrier being adapted to be brought from a starting bending position into a rest position where the bending tool carrier is located closer to a front surface of the respective beam in the rest position than in the starting position and where a bending space free from machine elements of the bending machine exists between the clamping plane and the bending tool located in the rest position and its bending tool carrier, said space extending over an angular area of at least 100° around the respectively operative bending edge.

2. A bending machine as defined in claim 1, wherein the bending space extends around the respectively operative bending edge over an angular area of at least 120°.

3. A bending machine as defined in claim 2, wherein the bending space extends around the operative bending edge over an angular area of at least 130°.

4. A bending machine as defined in claim 1, wherein the bending tool moving device of the bending tool located in a rest position is located outside the bending space defined by the angular area.

5. A bending machine as defined in claim 1, wherein the bending tool moving device for the respective bending tool is arranged between lateral end surfaces of the beams.

6. A bending machine as defined in claim 5, wherein in all the bending positions of the respective bending tool, the bending tool moving device for the bending tool is located exclusively on the side of the clamping plane where a starting bending position of the bending tool is located.

7. A bending machine as defined in claim 1, wherein in all the possible bending positions of the bending tool, the bending tool moving device extends between the machine frame and a front limiting plane extending through the bending tool and at right angles to the clamping plane.

8. A bending machine as defined in claim 1, wherein in all the possible bending positions of the bending tool, the bending tool moving device extends between the machine frame and a front plane extending through the bending edge and at right angles to the clamping plane.

9. A bending machine as defined in claim 1, wherein in all the possible bending positions of the bending tool, the bending tool carrier is located between the respective beam and a front limiting plane intersecting the bending tool and extending at right angles to the clamping plane.

10. A bending machine as defined in claim 1, wherein in all the possible bending positions of the bending tool, the bending tool carrier extends between the machine frame and a front plane extending through the bending edge and at right angles to the clamping plane.

11. A bending machine as defined in claim 1, wherein the bending tool not used for an operation on the flat material is always located in the rest position.

12. A bending machine as defined in claim 1, wherein at least one of the bending tool moving devices has a plurality of holding elements engaging in an area of the bending tool carrier facing the bending tool and arranged at fixed distances in a direction parallel to the longitudinal direction of the bending edge, said holding elements supporting the bending tool carrier in relation to the machine frame.

13. A bending machine as defined in claim 12, wherein the holding elements are designed as guide means for a defined movement of a point of engagement thereof on the bending tool carrier.

14. A bending machine as defined in claim 13, wherein the holding elements guide the point of engagement on a predetermined path.

15. A bending machine as defined in claim 12, wherein the holding elements engage on the bending tool carrier in an articulated manner.

16. A bending machine as defined in claim 12, wherein the holding elements are mounted for articulation in relation to the machine frame.

17. A bending machine as defined in claim 12, wherein the holding elements engage on the beam associated with the respective bending tool.

18. A bending machine as defined in claim 1, wherein the bending tool moving device engages at least partially on the beam associated with the bending tool.

19. A bending machine as defined in claim 18, wherein each of the bending tool moving devices has a plurality of holding elements which engage on the respective beam.

20. A bending machine as defined in claim 1, wherein the bending tool carrier drive unit for the respective bending tool is arranged on a beam carrier of the beam associated with the bending tool.

21. A bending machine as defined in claim 1, wherein the machine frame has at least two frame units holding the lower beam and the upper beam so as to be movable relative to one another, said frame units being arranged so as to follow one another in a direction parallel to the longitudinal direction of the bending edge.

22. A bending machine as defined in claim 21, wherein spaces are arranged between the frame units.

23. A bending machine as defined in claim 21, wherein each frame unit has a guide means for a defined movement of the lower beam and the upper beam relative to one another.

24. A bending machine as defined in claim 21, wherein each frame unit has a lower beam carrier and an upper beam carrier movable in a defined manner relative to one another by the guide means.

25. A bending machine as defined in claim 24, wherein the lower beam carriers of the plurality of frame units are rigidly connected to one another.

26. A bending machine as defined in claim 24, wherein at least one of the frame units has a drive for a relative movement of the lower beam and the upper beam with respect to one another.

27. A bending machine as defined in claim 21, wherein a bending tool carrier drive unit for the respective bending tool is associated with each of the frame units.

28. A bending machine as defined in claim 1, wherein at least one of the bending tools has a bending nose with a curved pressure surface for acting upon one side of the flat material.

29. A bending machine as defined in claim 28, wherein in all the bending positions the bending nose faces at least one of the clamping tools with a bending nose tip.

30. A bending machine as defined in claim 28, wherein during the pass through the bending positions, from a starting bending position to an end bending position, a contact line between the pressure surface and the side of the flat material acted upon moves in the direction of the bending edge on the side of the flat material acted upon.

31. A bending machine as defined in claim 30, wherein the pressure surface has an apex line located closest to the respective clamping tool in the starting bending position and extends away from the clamping tool proceeding from this apex line.

32. A bending machine as defined in claim 31, wherein the pressure surface of the bending nose has a front pressure surface section located so as to face away from the bending tool carrier and extending away from the apex line.

33. A bending machine as defined in claim 32, wherein the pressure surface has a rear pressure surface section located so as to face the bending tool carrier, said surface section, located opposite the front pressure surface section, extending away from the apex line.

34. A bending machine as defined in claim 32, wherein in the starting bending position, the contact line is located in the area of the front pressure surface section and moves in the direction of the apex line during bending.

35. A bending machine as defined in claim 34, wherein the bending nose is movable into such an end bending position where the contact line is located in the area of the rear pressure surface section.

36. A bending machine for flat material, comprising:

a machine frame, a lower beam arranged on the machine frame, said lower beam having a lower clamping tool, an upper beam arranged on the machine frame, said upper beam having an upper clamping tool, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, wherein:

each bending tool moving device comprises a plurality of bending tool carrier drive units for moving the bending tool between a starting bending position and an end bending position, said drive units being arranged so as to follow one another in a direction parallel to the longitudinal direction of the bending edge, and the bending tool not used for an operation on the flat material is adapted to be brought into a rest position where a bending space free from machine elements of the bending machine exists between the clamping plane and the bending tool located in the rest position and its bending tool carrier, said space extending over an angular area of at least 110° around the respectively operative bending edge.

37. A bending machine as defined in claim 36, wherein the bending tool is also movable by the bending tool carrier drive units between the rest position and the starting bending position.

38. A bending machine as defined in claim 36, wherein the bending tool carrier drive units engage on the bending tool carrier at a point of engagement and move this between the starting bending position and the end bending position on a path predetermined in a defined manner.

39. A bending machine as defined in claim 38, wherein said path is predeterminable by a pivoting movement about a pivot axis fixed in relation to the machine frame.

40. A bending machine as defined in claim 36, wherein the bending tool carrier drive units are drivable by a drive.

41. A bending machine as defined in claim 40, wherein each of the bending tool carrier drive units is drivable by its own drive.

42. A bending machine as defined in claim 40, wherein each of the bending tool carrier drive units comprises a pivotally drivable drive arm pivotable at a first end about an axis fixed in relation to the frame and pivotally connected to the bending tool carrier at a second end via an elbow joint.

43. A bending machine as defined in claim 36, wherein each of the bending tool carrier drive units has an elbow lever drive system for moving the bending tool carrier.

44. A bending machine as defined in claim 43, wherein a first lever of the elbow lever drive system is pivotable about an axis fixed in relation to the machine frame.

45. A bending machine as defined in claim 44, wherein the drive arm forms the first lever of the elbow lever drive system.

46. A bending machine as defined in claim 43, wherein the bending tool carrier forms at least part of a second lever of the elbow lever drive system.

47. A bending machine as defined in claim 42, wherein the drive arm is designed so as to be variable in length with respect to its distance between a first end and its second end.

48. A bending machine as defined in claim 47, wherein the drive arm is adjustable via a drive so as to be variable in length.

49. A bending machine as defined in claim 48, wherein the drive for pivoting the drive arm also serves as a drive for the length adjustment of the drive arm.

50. A bending machine as defined in claim 47, wherein the drive arm is variable in length via an elbow lever mechanism.

51. A bending machine as defined in claim 50, wherein the elbow lever mechanism is adapted to be secured in different extended positions to determine different lengths of the drive arm.

52. A bending machine as defined in claim 51, wherein the elbow lever mechanism is adapted to be blocked by a blocking device to determine the different extended positions.

53. A bending machine for flat material, comprising:

a machine frame, a lower beam arranged on the machine frame, said lower beam having a lower clamping tool, an upper beam arranged on the machine frame, said upper beam having an upper clamping tool, said machine frame being designed to be laterally open on at least one of its transverse sides for the insertion of flat material in the longitudinal direction of the bending edge and between the upper and lower beams, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, wherein:

the bending tool not used for an operation on the flat material is adapted to be brought into a rest position where a bending space free from machine elements of the bending machine exists between the clamping plane and the bending tool located in the rest position and its bending tool carrier, said space extending over an angular area of at least 110° around the respectively operative bending edge.

54. A bending machine as defined in claim 53, wherein the machine frame is designed to be laterally open in the area of the clamping tools for the insertion of flat material also between the clamping tools.

55. A bending machine for flat material, comprising:

a machine frame designed to be free from any side columns, a lower beam arranged on the machine frame, said lower beam having a lower clamping tool, an upper beam arranged on the machine frame, said upper beam having an upper clamping tool, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, and the bending tool not used for an operation on the flat material and its corresponding bending tool carrier being adapted to be brought from a starting bending position into a rest position where a bending space free from machine elements of the bending machine exists between the clamping plane and the bending tool located in the rest position and its bending tool carrier, said space extending over an angular area of at least 100° around the respectively operative bending edge.

56. A bending machine for flat material, comprising:

a machine frame, a lower beam arranged on the machine frame, said lower beam having a lower clamping tool, an upper beam arranged on the machine frame, said upper beam having an upper clamping tool, the machine frame having at least two frame units holding the lower beam and the upper beam so as to be movable relative to one another, said frame units being arranged so as to follow one another in a direction parallel to the longitudinal direction of the bending edge, each frame unit having a guide means for a defined movement of the lower beam and the upper beam relative to one another, the lower beam and the upper beam being pivotable relative to one another about a pivot axis of the guide means, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, and the bending tool not used for an operation on the flat material and its corresponding bending tool carrier being adapted to be brought from a starting bending position into a rest position where a bending space free from machine elements of the bending machine exists between the clamping plane and the bending tool located in the rest position and its bending tool carrier, said space extending over an angular area of at least 100° around the respectively operative bending edge.

57. A bending machine as defined in claim 56, wherein the pivot axis is arranged at a distance from the clamping tools on a side thereof located opposite the bending tool.

58. A bending machine for flat material, comprising:

a machine frame, a lower beam arranged on the machine frame, said lower beam having a lower clamping tool, an upper beam arranged on the machine frame, said upper beam having an upper clamping tool, the machine frame having at least two frame units holding the lower beam and the upper beam so as to be movable relative to one another, said frame units being arranged so as to follow one another in a direction parallel to the longitudinal direction of the bending edge, each of the frame units having its own drive for a relative movement of the lower beam and the upper beam with respect to one another, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, and the bending tool not used for an operation on the flat material and its corresponding bending tool carrier being adapted to be brought from a starting bending position into a rest position where a bending space free from machine elements of the bending machine exists between the clamping plane and the bending tool located in the rest position and its bending tool carrier, said space extending over an angular area of at least 100° around the respectively operative bending edge.

59. A bending machine for flat material, comprising:

a machine frame, a lower beam arranged on the machine frame, said lower beam having a lower clamping tool, an upper beam arranged on the machine frame, said upper beam having an upper clamping tool, the machine frame having at least two frame units holding the lower beam and the upper beam so as to be movable relative to one another, said frame units being arranged so as to follow one another in a direction parallel to the longitudinal direction of the bending edge, the frame units engaging on the upper beam and the lower beam on a side facing away from the clamping tools, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, and the bending tool not used for an operation on the flat material and its corresponding bending tool carrier being adapted to be brought from a starting bending position into a rest position where a bending space free from machine elements of the bending machine exists between the clamping plane and the bending tool located in the rest position and its bending tool carrier, said space extending over an angular area of at least 110° around the respectively operative bending edge.

60. A bending machine for flat material, comprising:

a machine frame, a lower beam arranged on the machine frame, said lower beam having a lower clamping tool, an upper beam arranged on the machine frame, said upper beam having an upper clamping tool, the machine frame having at least two frame units holding the lower beam and the upper beam so as to be movable relative to one another, said frame units being arranged so as to follow one another in a direction parallel to the longitudinal direction of the bending edge, the frame units being arranged between lateral end surfaces of the upper beam and the lower beam, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, and the bending tool not used for an operation on the flat material and its corresponding bending tool carrier being adapted to be brought from a starting bending position into a rest position where a bending space free from machine elements of the bending machine exists between the clamping plane and the bending tool located in the rest position and its bending tool carrier, said space extending over an angular area of at least 110° around the respectively operative bending edge.

61. A bending machine for flat material, comprising:

a machine frame, a lower beam arranged on the machine frame, said lower beam having a lower clamping tool, an upper beam arranged on the machine frame, said upper beam having an upper clamping tool, said flat material being fixable in a clamping plane with said beams, a lower bending tool moving device associated with the lower beam for moving a lower bending tool carrier with a lower bending tool for bending the flat material about an upper bending edge relative to the clamping plane between a rest position and a plurality of bending positions, an upper bending tool moving device associated with the upper beam for moving an upper bending tool carrier with an upper bending tool for bending the flat material about a lower bending edge relative to the clamping plane between a rest position and a plurality of bending positions, wherein:

the respective bending tool used for an operation on the flat material is movable by the bending tool moving device between a starting bending position and an end bending position on a path about the respective bending edge, said path being predetermined in a defined manner such that a curved pressure surface on a bending nose of the respective bending tool and the side of the flat material acted upon move relative to one another in the form of an essentially slide-free rolling on one another, and the bending tool not used for an operation on the flat material is adapted to be brought into a rest position where a bending space free from machine elements of the bending machine exists between the clamping plane and the bending tool located in the rest position and its bending tool carrier, said space extending over an angular area of at least 100° around the respectively operative bending edge.

62. A bending machine as defined in claim 61, wherein the path of the bending tool is predetermined in a defined manner by a mechanical path guide means.

63. A bending machine as defined in claim 62, wherein the path of the bending tool is predetermined by at least one pivoting movement.

64. A bending machine as defined in claim 63, wherein the path of the bending tool is predetermined by way of superposition of at least two pivoting movements.

* * * * *